US008610638B2

(12) United States Patent
Larsen et al.

(10) Patent No.: US 8,610,638 B2
(45) Date of Patent: Dec. 17, 2013

(54) FM TRANSMISSION USING A RFID/NFC COIL ANTENNA

(75) Inventors: Niels B. Larsen, Kgs. Lyngby (DK); Jouni V. Karkinen, Oulu (FI)

(73) Assignee: Nokia Corporation, Espoo (FI)

( * ) Notice: Subject to any disclaimer, the term of this patent is extended or adjusted under 35 U.S.C. 154(b) by 380 days.

(21) Appl. No.: 13/007,710

(22) Filed: Jan. 17, 2011

(65) Prior Publication Data

US 2012/0182198 A1 Jul. 19, 2012

(51) Int. Cl.
*H01Q 7/00* (2006.01)
*H01Q 21/00* (2006.01)

(52) U.S. Cl.
USPC ..... 343/866; 343/743; 343/728; 343/867

(58) Field of Classification Search
None
See application file for complete search history.

(56) References Cited

U.S. PATENT DOCUMENTS

| | | | | |
|---|---|---|---|---|
| 5,767,812 | A | 6/1998 | Basciano et al. | 343/722 |
| 6,950,410 | B1 | 9/2005 | Brandt | 370/276 |
| 7,248,165 | B2 | 7/2007 | Collins et al. | 340/572.1 |
| 7,376,440 | B2 | 5/2008 | Forrester et al. | 455/553.1 |
| 7,650,114 | B2 | 1/2010 | Tsirline et al. | 455/41.2 |
| 7,701,401 | B2 | 4/2010 | Suzuki et al. | 343/702 |
| 7,760,093 | B2 | 7/2010 | Rofougaran | 340/572.1 |
| 7,843,347 | B2 | 11/2010 | Nikitin et al. | 340/572.7 |
| 8,063,769 | B2 | 11/2011 | Rofougaran | 340/539.1 |
| 8,344,959 | B2 * | 1/2013 | Autti et al. | 343/744 |
| 2007/0190939 | A1 | 8/2007 | Abel et al. | 455/41.2 |
| 2008/0081631 | A1 | 4/2008 | Rofougaran | 455/452.1 |
| 2008/0233868 | A1 | 9/2008 | Rofougaran et al. | 455/41.1 |
| 2008/0233880 | A1 | 9/2008 | Rofougaran et al. | 455/42 |
| 2008/0252534 | A1 | 10/2008 | Okayama et al. | 343/702 |
| 2008/0287071 | A1 | 11/2008 | Gau et al. | 455/73 |
| 2009/0073070 | A1 * | 3/2009 | Rofougaran | 343/793 |
| 2009/0096685 | A1 | 4/2009 | Harano | 343/702 |
| 2009/0153421 | A1 | 6/2009 | Rofougaran et al. | 343/745 |
| 2009/0251383 | A1 | 10/2009 | Tani et al. | 343/852 |
| 2009/0322634 | A1 | 12/2009 | Yun et al. | 343/741 |
| 2010/0279734 | A1 * | 11/2010 | Karkinen et al. | 455/554.2 |

FOREIGN PATENT DOCUMENTS

| | | | |
|---|---|---|---|
| EP | 2 065 969 | A1 | 6/2009 |
| EP | 2 219 265 | A1 | 8/2010 |
| EP | 2 221 914 | A1 | 8/2010 |
| EP | 1 966 852 | B1 | 9/2010 |
| JP | 56160148 | A | 12/1981 |
| JP | 2003133991 | A | 5/2003 |

(Continued)

OTHER PUBLICATIONS

"Built-In-Handset Antennas Enable FM Transceivers in Mobile Phones", Peter Lindberg and Andrei Kaikkonen, Jul. 2007, pp. 18-24.

*Primary Examiner* — Trinh Dinh
(74) *Attorney, Agent, or Firm* — Harrington & Smith

(57) ABSTRACT

An antenna radiating element is arranged as at least one coil and defines a first feed port and a second feed port at its opposed ends. There is a third feed port disposed along the antenna radiating element substantially at a radio frequency effective symmetry point between the first and the second radio feed ports. The first and second feed ports are for interfacing a first radio (e.g., RFID/NFC radio) to the antenna radiating element, and the third feed port is for interfacing a second radio (e.g., FM-TX) to the antenna radiating element. The antenna radiating element is configured to function simultaneously as a balanced coil antenna with respect to the first radio and as two parallel half-loop antennas with respect to the second radio.

17 Claims, 22 Drawing Sheets

(56) References Cited

FOREIGN PATENT DOCUMENTS

| | | | |
|---|---|---|---|
| WO | WO-2005/104389 | A1 | 11/2005 |
| WO | WO-2006/064590 | A1 | 6/2006 |
| WO | WO-2006/082328 | A2 | 8/2006 |
| WO | WO-2006/088422 | A1 | 8/2006 |
| WO | WO-2009/070100 | A1 | 6/2009 |

* cited by examiner

| FIG.4A | FIG.4B |
|---|---|

| FIG.5A | FIG.5B |
|---|---|

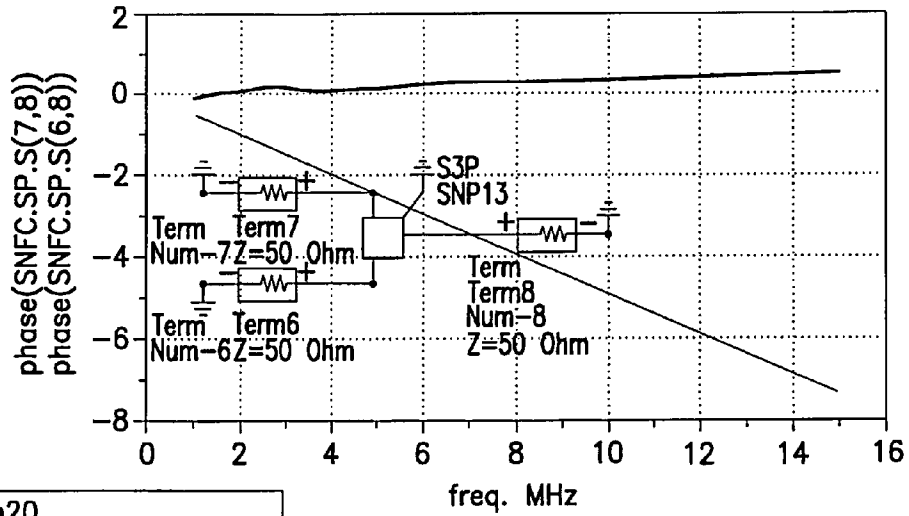
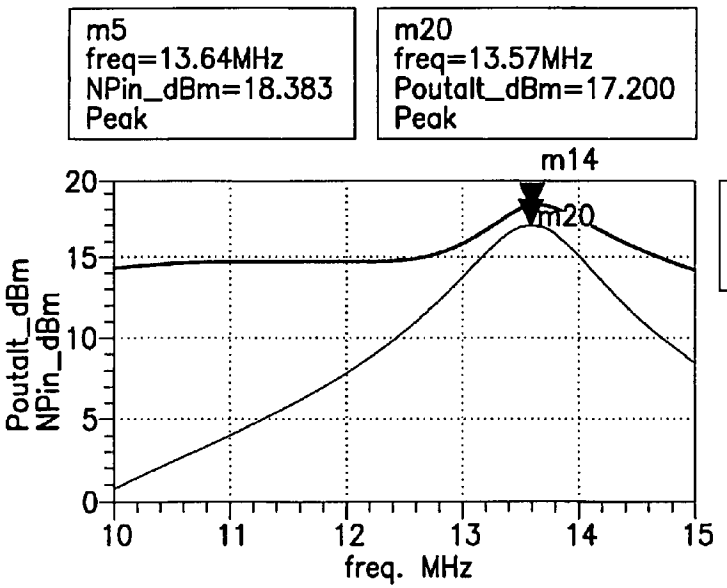
FIG.6
FIG.6A FIG.6B
FIG.6B

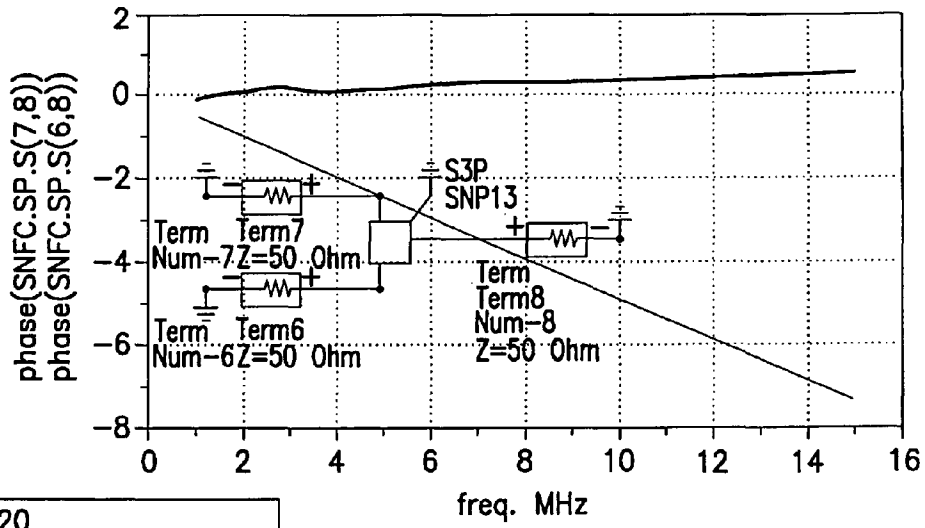
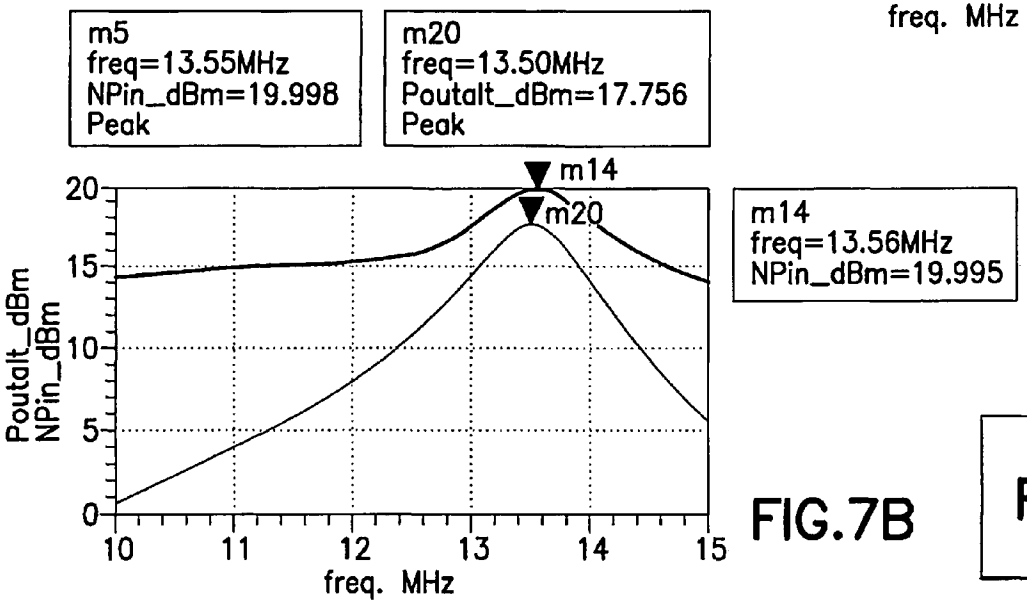
FIG.7
FIG.7A FIG.7B
FIG.7B

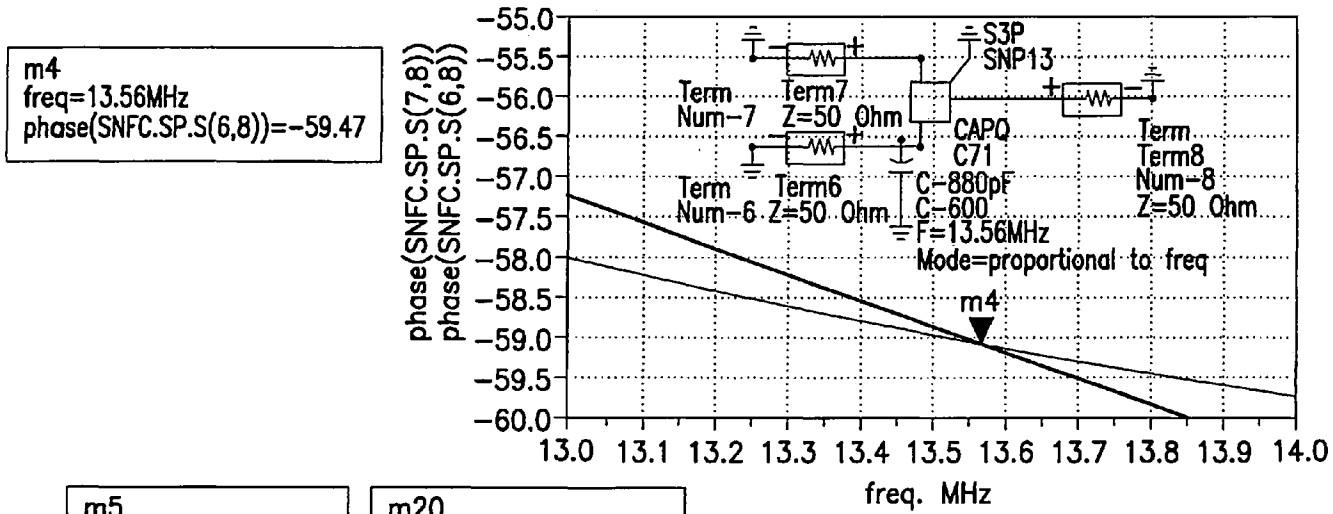
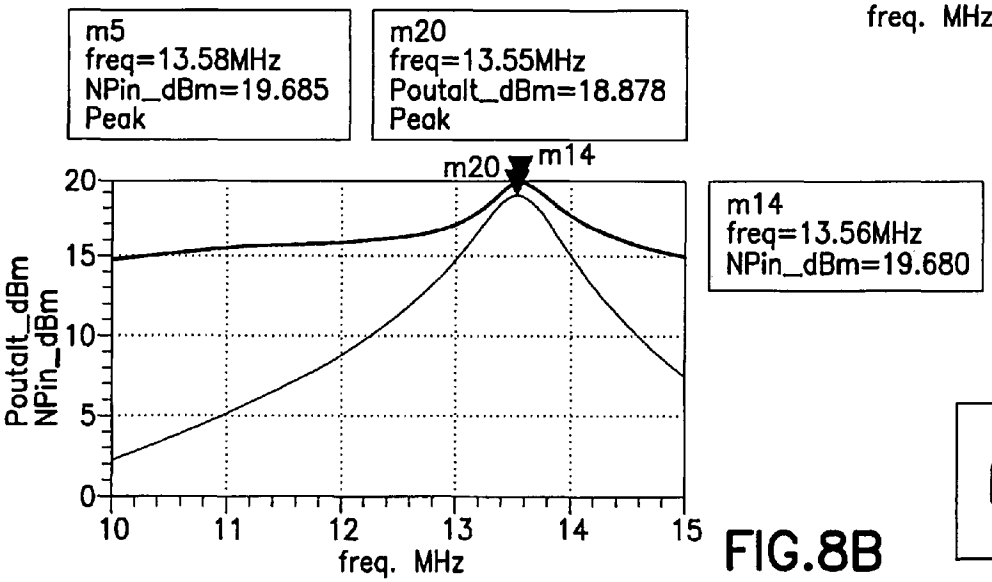
FIG.8
FIG.8A FIG.8B
FIG.8B

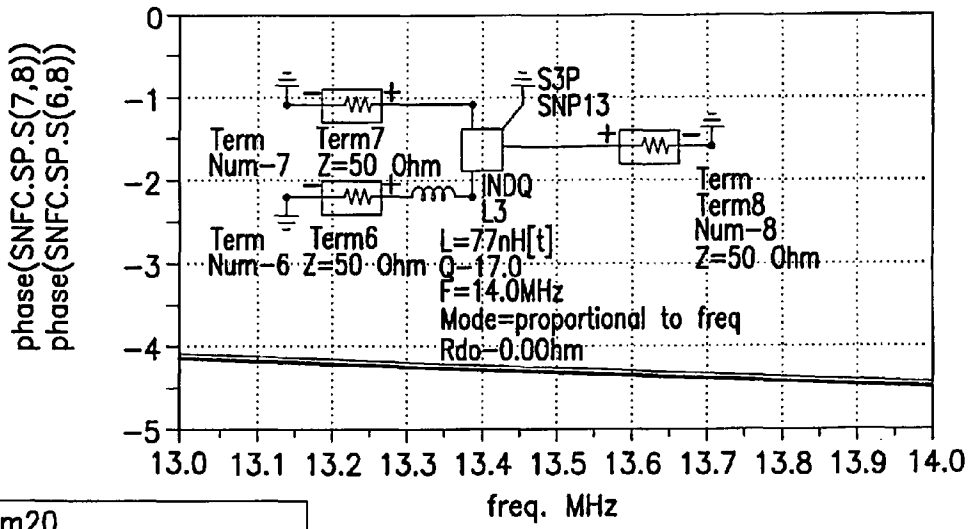
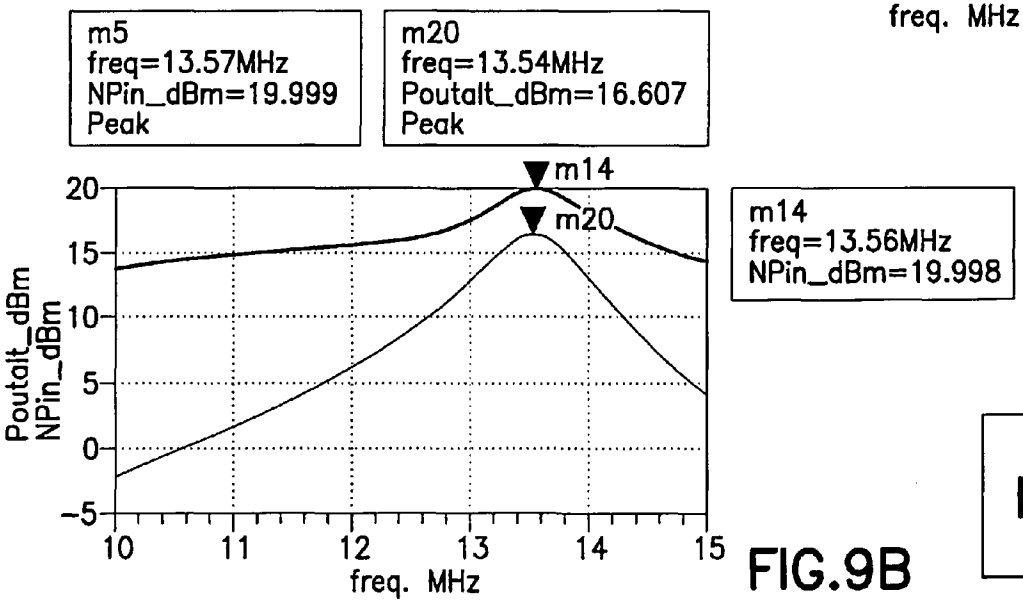
FIG.9
FIG.9A FIG.9B
FIG.9B

FM TRANSMISSION USING A RFID/NFC COIL ANTENNA

CROSS REFERENCE TO RELATED APPLICATIONS

These teachings concern subject matter related to that disclosed at co-owned U.S. patent application Ser. No. 12/387,355 (filed on Apr. 30, 2009 and published as US 2010/0277383) and Ser. No. 12/771,174 (filed on Apr. 30, 2010 and published as US 2010/0279734). The entirety of both those related applications are hereby incorporated by reference.

TECHNICAL FIELD

Embodiments of this invention relate generally to wireless communication systems, methods, devices and computer programs and, more specifically, exemplary embodiments thereof relate to a single antenna radiating element or coil for use in different radio technologies such as for example RFID/NFC and FM transmissions.

BACKGROUND

Mobile radio handsets often incorporate multiple radios that operate over different protocols and different frequency bands, each of which must operate with an antenna tuned to the relevant band. Typically, near-field communications (NFC, a member of the broader radio frequency identification RFID technologies), Bluetooth, wireless local area network WLAN, and global positioning systems GPS are implemented with separate antennas. Where the handset also includes an internal frequency modulated FM radio, typically there is also an internal FM receiver (RX) including antenna and an internal FM transmitter (TX) with an antenna that may be separate from the FM-RX antenna.

All of this hardware of course must be fit into a handheld-size package, of which the housing itself and the user's hand placement thereon must either facilitate the proper antenna resonances or at least not interfere. This problem of space is generally more acute if the handset housing is metal as with the Nokia N8 handset rather than plastic as has been recently common. The overall electronics layout in the handset must account for antennas to support cellular radio(s) as well as secondary radios such as Bluetooth, WLAN, GPS, RFID/NFC, and/or FM as the case may be. While some of those secondary radio antennas can be made quite small, typically the FM antenna(s) and the RFID/NFC antenna require much more space than the others.

Utilizing one physical antenna radiator for multiple different-band radios simplifies the electronics layout and eases the physical space constraints. By example a Bluetooth/WLAN antenna combined to a FM band radiator is known, often utilizing an unbalanced (non-loop) configuration for the FM TX antenna. But there is an additional challenge in such a combined antenna in that it is difficult to get sufficient output power to the physically large FM-TX antenna radiator element. Satisfying the dual constraints of space and output power are particularly challenging for a small package such as a mobile handset.

Typically, FM-TX antennas for hand-portable devices are implemented as a coil or monopole type antenna. NFC antennas are typically implemented as a coil or winding of conductive material which is fed differentially (balanced). As above, both are relatively large in the context of mobile handsets. In the above referenced co-owned U.S. patent applications there is an embodiment in which both RFID/NFC and FM-TX radios are connected to the same antenna feed using filters for proper frequency isolation of the different bands.

Certain prior art approaches for coil antennas for NFC and/or FM-TX uses may be seen by example at EP Patent Publications 1,966,852, 2,065,969, 2,219,265 and 2,221,914; and further at US Patent Publications 2008/0081631 and 2008/0233868.

SUMMARY

In a first aspect the exemplary embodiments of the invention provide an apparatus comprising: an antenna radiating element arranged as at least one coil and defining a first feed port and a second feed port at opposed ends of the antenna radiating element, in which the first and second feed ports are for interfacing a first radio to the antenna radiating element; a third feed port disposed along the antenna radiating element substantially at a radio frequency effective symmetry point between the first and the second radio feed ports. The third feed port is for interfacing a second radio to the antenna radiating element.

The apparatus as above, further comprising the first radio coupled to the first and second feed ports and the second radio coupled to the third feed port, in which the first radio comprises a RFID radio and the second radio comprises a broadcast FM radio transmitter.

In a second aspect the exemplary embodiments of the invention provide a method comprising: providing an antenna radiating element arranged as at least one coil and defining a first feed port and a second feed port at opposed ends of the antenna radiating element, and further defining a third feed port disposed along the antenna radiating element substantially at a radio frequency effective symmetry point between the first and the second radio feed ports; coupling a first radio to the first and second feed ports; and coupling a second radio to the third feed port.

BRIEF DESCRIPTION OF THE DRAWINGS

FIG. 5 displays the reference output power of RFID/NFC without FM attached. FIG. 6 displays the output power of RFID/NFC with the third feedpoint connected to low impedance. FIG. 7 displays the output power of RFID/NFC with the third feedpoint connected to a 50 ohm resistor.

DETAILED DESCRIPTION

As noted in the background section above, a multi-radio antenna embodiment detailed at co-owned U.S. patent application Ser. No. 12/387,355 connects a RFID/NFC radio and a FM-TX radio to a common radiating element and utilizes various filtering means to isolate the different bands. In certain exemplary embodiments of these teachings there is similarly a single antenna radiator to which a RFID/NFC and a FM-TX radio are coupled, but in these teachings there is no need to further include those filtering components for isolating the different bands from one another; instead band separation results from the fact that these two radios are coupled to the common coil-type radiator element by different feeds whose relative location provides the band isolation naturally. The RFID/NFC radio is fed differentially across two feeds and so is balanced. The FM-TX (and in some embodiments also the FM-RX) is fed also to the coil radiating element via a feed which is located along the length of the coil rather than at an end thereof.

The relative positions of the FM feed versus the RFID/NFC feeds provide advantages for certain of the exemplary embodiments detailed herein. In a first embodiment the relative positions are simply physical disposition along the coil. In a second embodiment the ideal physical position may be moved somewhat, to an extent compensated by added circuitry which makes the effective RF length the same as that of the first embodiment.

Figure 1A:
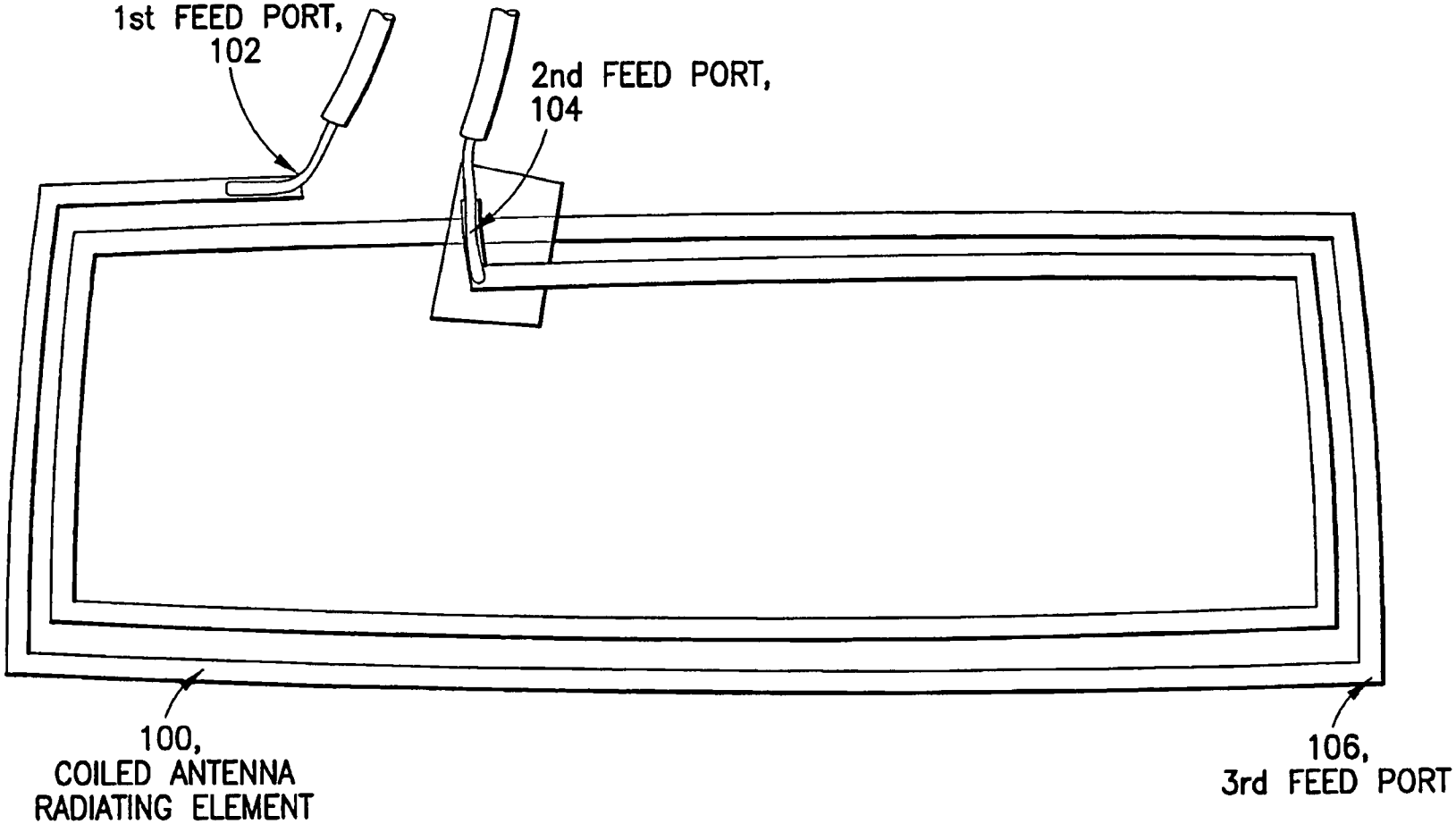
FIG. 1A is a plan view illustration of a coil antenna radiator element according to a first exemplary embodiment of these teachings.

An exemplary but non-limiting implementation of the first embodiment of such a coil antenna radiating element is detailed at FIG. 1A, which is an image of the inventors' actual reduction to practice. There is a coil radiating element 100 defining a first end 102 and an opposed second end 104. Coil as used herein means that the physical arrangement of the element 100 defines at least one turn of substantially 360 degrees between the opposed ends 102, 104; the FIG. 1A example is substantially 720 degrees since both ends 102, 104 feed to/from the same radio as is detailed below. That is, substantially 360 degrees as referring to the coil may be slightly less than a true 360 degrees so long as both ends 102, 104 feed the same radio. This allows a minor deviation from true 360 degrees, which typically would be within the range of about 2% or 7 degrees less than the full 360.

In exemplary embodiments the coil radiating element 100 may be implemented as a self-supporting wire as shown at FIG. 1A or as a conductive track or trace disposed on a supporting substrate such as a silicon or plastic film or a surface of a mobile handset housing. For the case in which such a housing is metal or otherwise conductive, an intervening insulating layer may be disposed between the track/trace and the housing. There may also be a ferrite or ferrous material layer between the conductive track/trace and an underlying conductive object, for example a large battery typically has an outer case which is conductive and may affect the performance of the coil for near field communication. For the case in which the track/trace is disposed on an exterior surface of the housing, there may be an insulating overlayer disposed opposite the housing exterior surface to cover the track/trace.

By example at FIG. 1A the first end 102 and the second end 104 serve as respective first and second feed ports which interface a single RFID/NFC radio or engine to the coil radiating element 100. There is also a third feed port 106 which interfaces a FM-TX radio or engine to the coil radiating element 100. There may also be a FM-RX radio, or even a combined FM TX/RX radio or engine interfaced through this same third feed port 106.

Because the radiating element 100 is a coil which the RFID/NFC engine feeds at the first 102 and second 104 ends/ports, the loop radiator element 100 is balanced in that there are two ports or terminals 102, 104, neither of which is a ground connection. The FM transmit radio FM-TX feeds into this balanced loop radiator element 100 at the third feed port 106, which differs from certain prior art single-ended FM loop antennas characterized by one end being an RF feed and the other end being grounded.

Figure 1B:
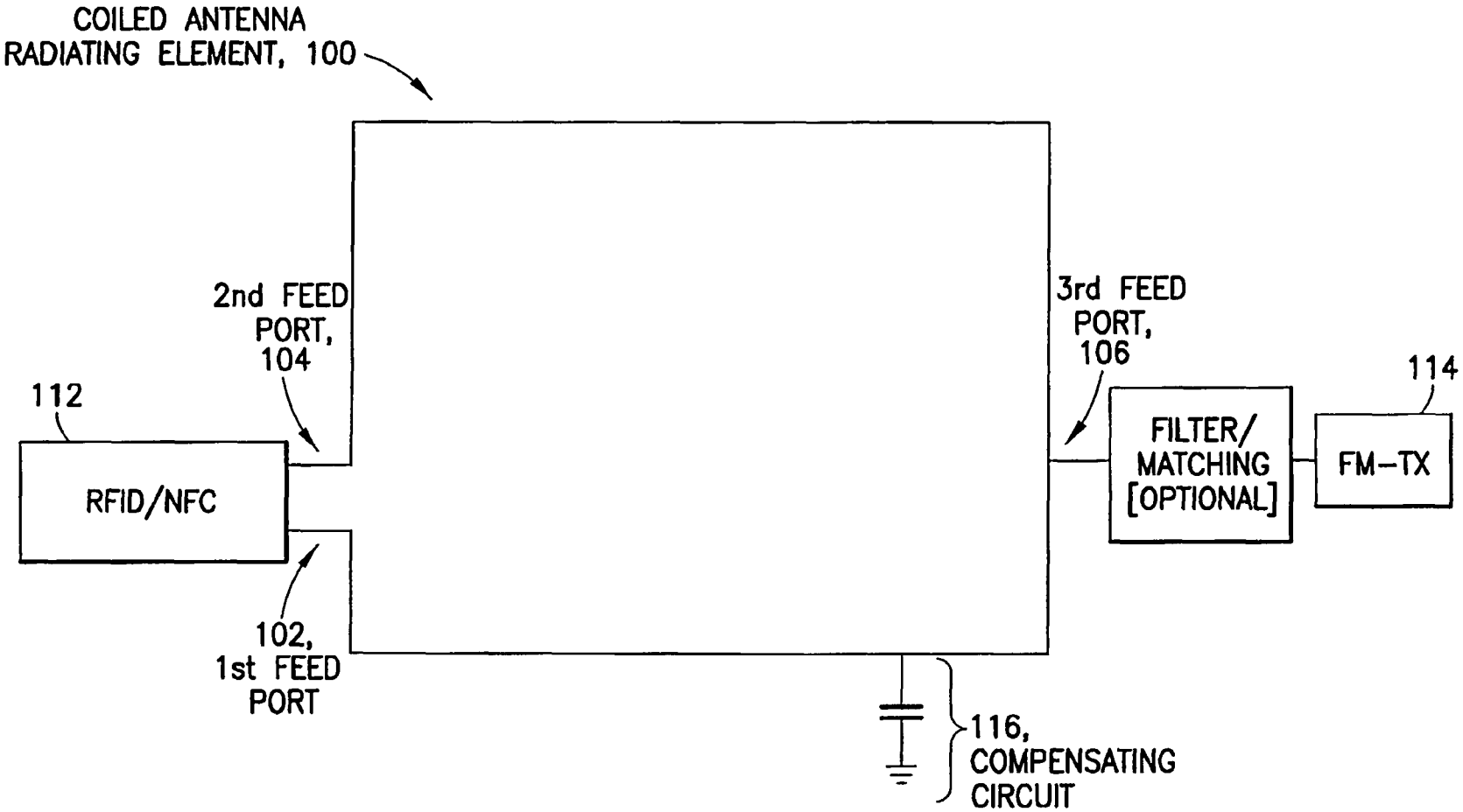
FIG. 1B is a circuit diagram of a coil antenna radiator element with two radios interfaced thereto according to a second exemplary embodiment of these teachings and further showing an optional matching circuit which may include RFID/NFC bandpass to ground.

Another aspect of the coil radiating element 100 of FIG. 1 is the location of the FM-TX feed port 106; it is provided substantially at either the symmetry point of the RFID/NFC coil (the halfway point along the physical length of the coil 100) in accordance with the first embodiment shown at FIG. 1A, or at the equivalent RF symmetry point which is compensated to be the RF-effective symmetry point of the RFID/NFC coil by compensation circuitry in accordance with the second embodiment shown at FIG. 1B and detailed further below. Substantially at the symmetry point or equivalent RF symmetry point as used herein may generally be considered to be within 10% of the true symmetry point or equivalent RF symmetry point, as the case may be, but variance from the above 10% may still be practical depending on total length of the coil and whether the RFID/NFC and FM radios are disposed on opposed sides of a printed wiring board PWB and coil.

As shown at the FIG. 1A the first embodiment, the physical symmetry point at which the FM feed port 106 is disposed is necessarily located along the coil opposite the RFID/NFC feed ports 102, 104 (e.g., halfway around the circumference of the coil 100 relative to the RFID/NFC ports).

The second embodiment at FIG. 1B shows the first, second and third feed ports similar to those described for FIG. 1A, but for simplicity of illustration the antenna radiating element 100 has only one coil at FIG. 1B. There is also shown at FIG. 1B the RFID/NFC radio 112 and the FM radio 114. All these components are present also within the first embodiment though not specifically shown at FIG. 1A.

Note that the RFID/NFC 112 and the FM 114 radio therefore utilize the radiating element 100 in different RF configurations. For the first embodiment in which the FM feed port 106 is halfway along the radiating element 100 between the first 102 and second 104 feed ports, the radiating element operates as two half-loop antennas in parallel for the FM radio 114 (half-loop being fed at one end and grounded at the other) and as a balanced loop antenna for the RFID/NFC radio 112. Since there is no selective coupling of either radio 112, 114 to the coil radiating element at FIG. 1B, the antenna is functional simultaneously for the RFID/NFC radio as a balanced loop antenna and for the FM radio as parallel half-loop antennas.

Consider FIG. 1B a bit more closely. Though the drawing is not to scale note that the third feed port 106 is distinctly closer along the radiating element 100 to the first feed port 102 than to the second feed port 104. In the second embodiment the physical length along the radiating element 100 between the third feed port 106 and the first 102 and second 104 feed port need not be substantially the same as with the first embodiment. Instead the physical length may differ beyond some minimal length but the difference is compensated by circuitry coupled to the radiating element 100 which, in effect, adjusts the effective RF lengths to be substantially equal.

An effective electrical length of a conductor can be adjusted by adding circuitry to the conductor without changing a physical length of the conductor itself The effective RF length is the same concept but specifically for a radiating element 100. For the case in which there is no additional circuitry affecting the RF effective length then the RF effective length is the physical length itself This leads to the first embodiment in which the third feed port 106 is disposed halfway along the radiating element 100 so that a first distance along the radiating element 100 between the third feed port 106 and the first feed port 102 is equal in actual length to a second distance along the radiating element 100 between the third feed port 106 and the second feed port 104.

Where these two physical distances differ, the third feed port 106 lies at the effective RF symmetry point when those two RF effective distances are substantially equal. The second embodiment encompasses those implementations in which the different physical distances are made substantially RF effectively equal by compensating circuitry. By example, the physical length between the third feed port 106 and the first feed port 102 is the shorter distance at FIG. 1B, and so the compensating circuit 116 couples to the radiating element 100 along that shorter length which effectively lengthens it.

Certain advantages that these various embodiments provide is that the need for sharp filtering is reduced, which reduces the performance penalty such sharp filtering imposes. Another advantage is that the single coil 100 may be used for two distinct radios RFID/NFC and FM (FM-TX and/or also FM-RX), which greatly simplifies the electronics layout for designing a mobile handset as compared to having to design space and interference-free locations for two different antennas. And of course there is the cost savings in having fewer physical antennas and fewer antenna matching components when there is one radiating element as opposed to two.

Figure 2:
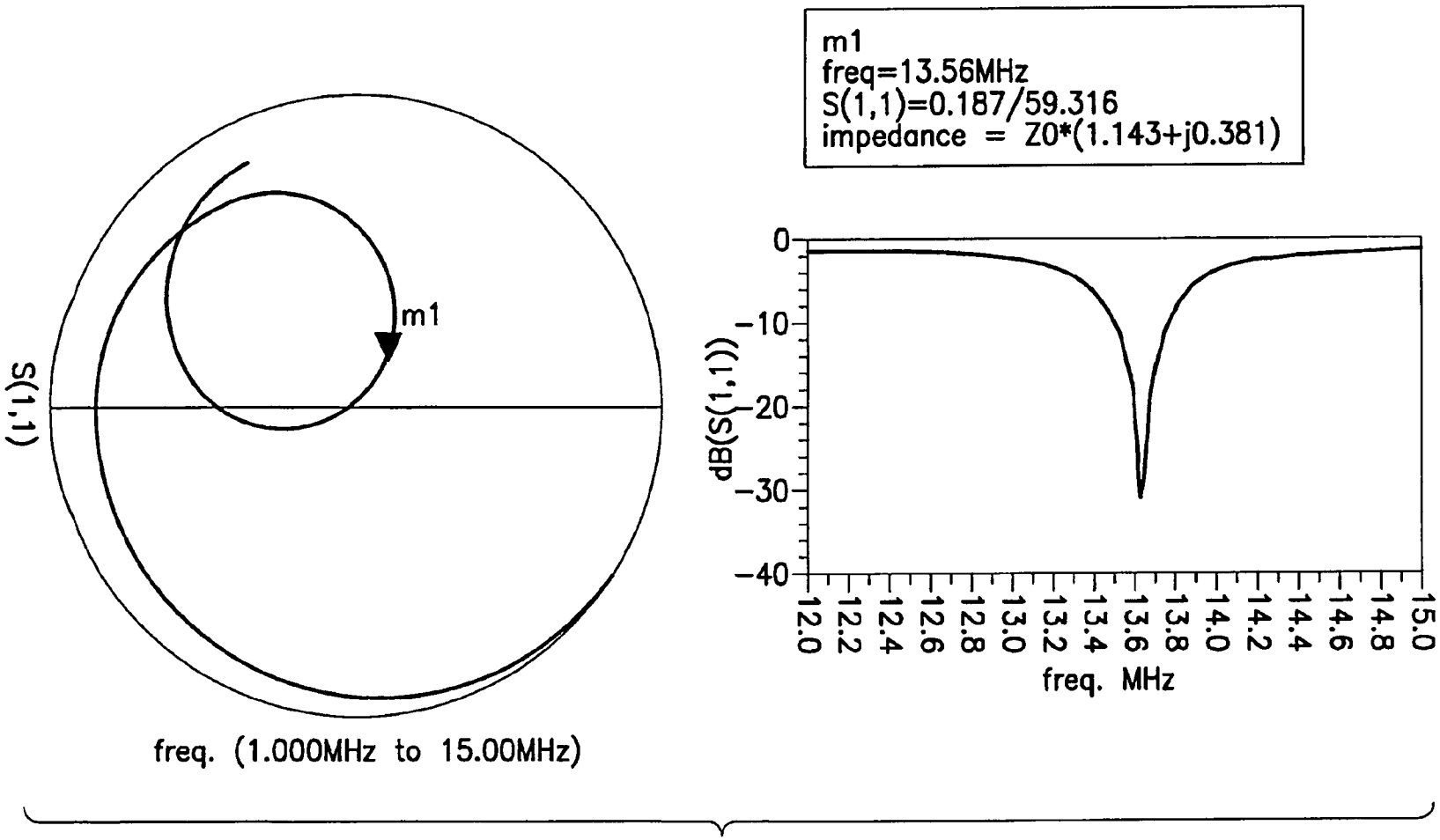
FIGS. 2-3 are Smith charts and accompanying dB v frequency plots for RFID/NFC impedance from the antenna embodiment of FIGS. 1A-B with and without the FM-TX engine attached.
Figure 3:
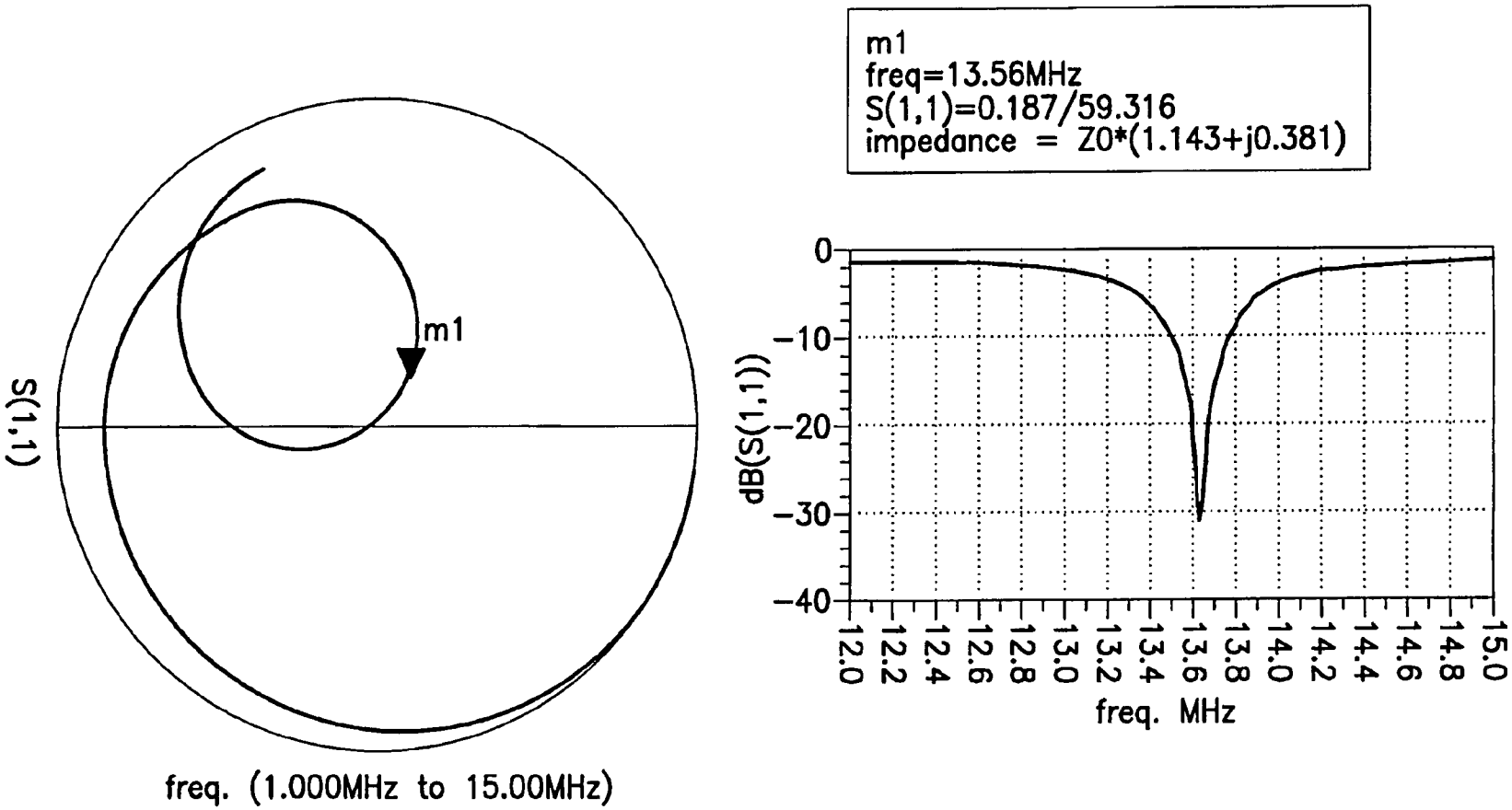

FIG. 2 is a Smith chart showing measurements of the RFID/NFC impedance from the FIG. 1B antenna with two windings as in FIG. 1A to which there is no FM radio at all connected, and FIG. 3 is a similar Smith chart for the case in which there is an FM radio connected. Comparing the two shows a good baseline that coupling an RFID/NFC and an FM radio to the same radiating element 100 has minimal adverse effect on the RFID/NFC radio performance.

Figures 4, 4A:
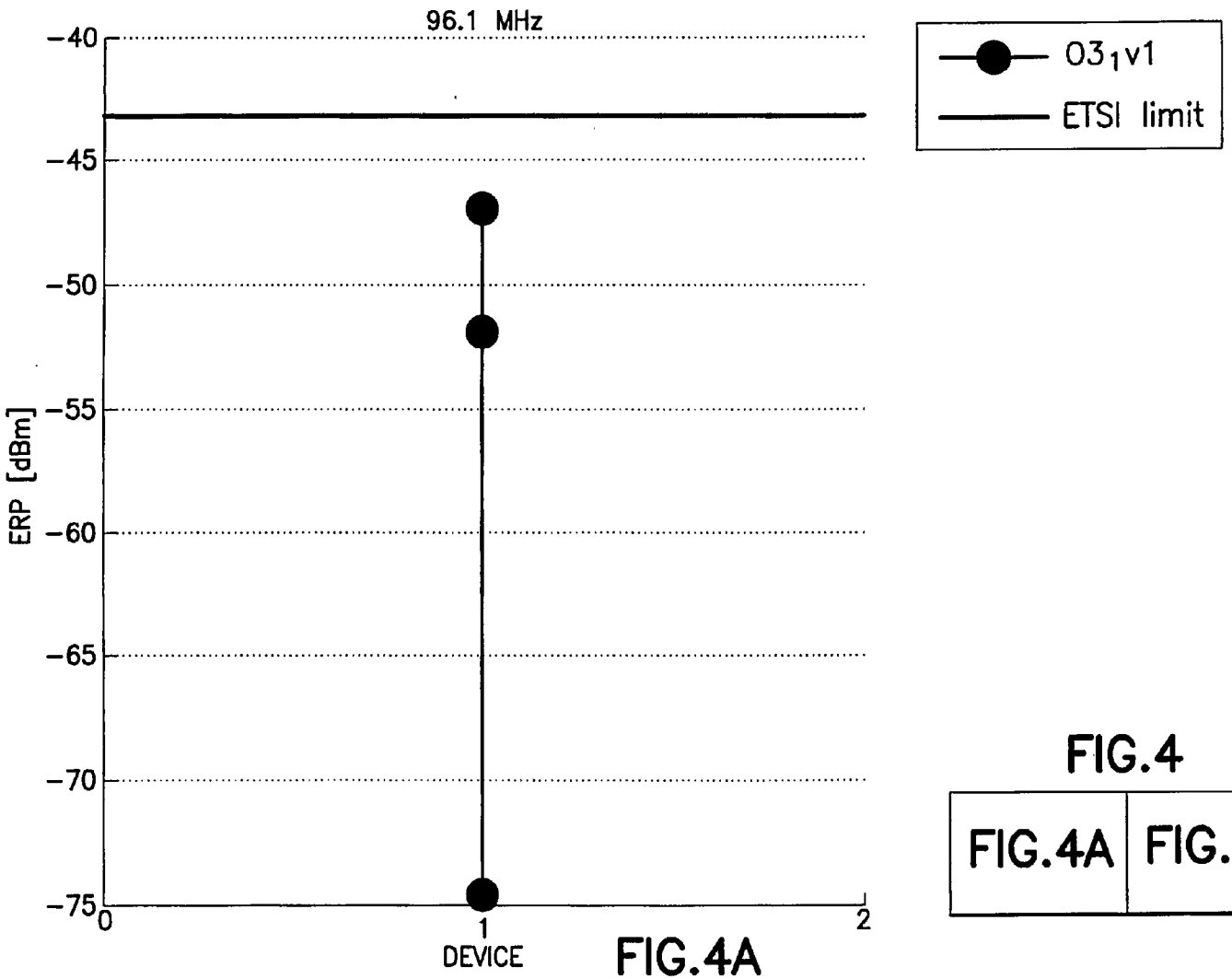
FIG. 4 is a chart of effective radiated power ERP from the FM radio utilizing the antenna of FIGS. 1A-B as minimum, maximum and linear average and additional the ERP in three principal cuts with ETSI pattern limits.
Figure 4B:
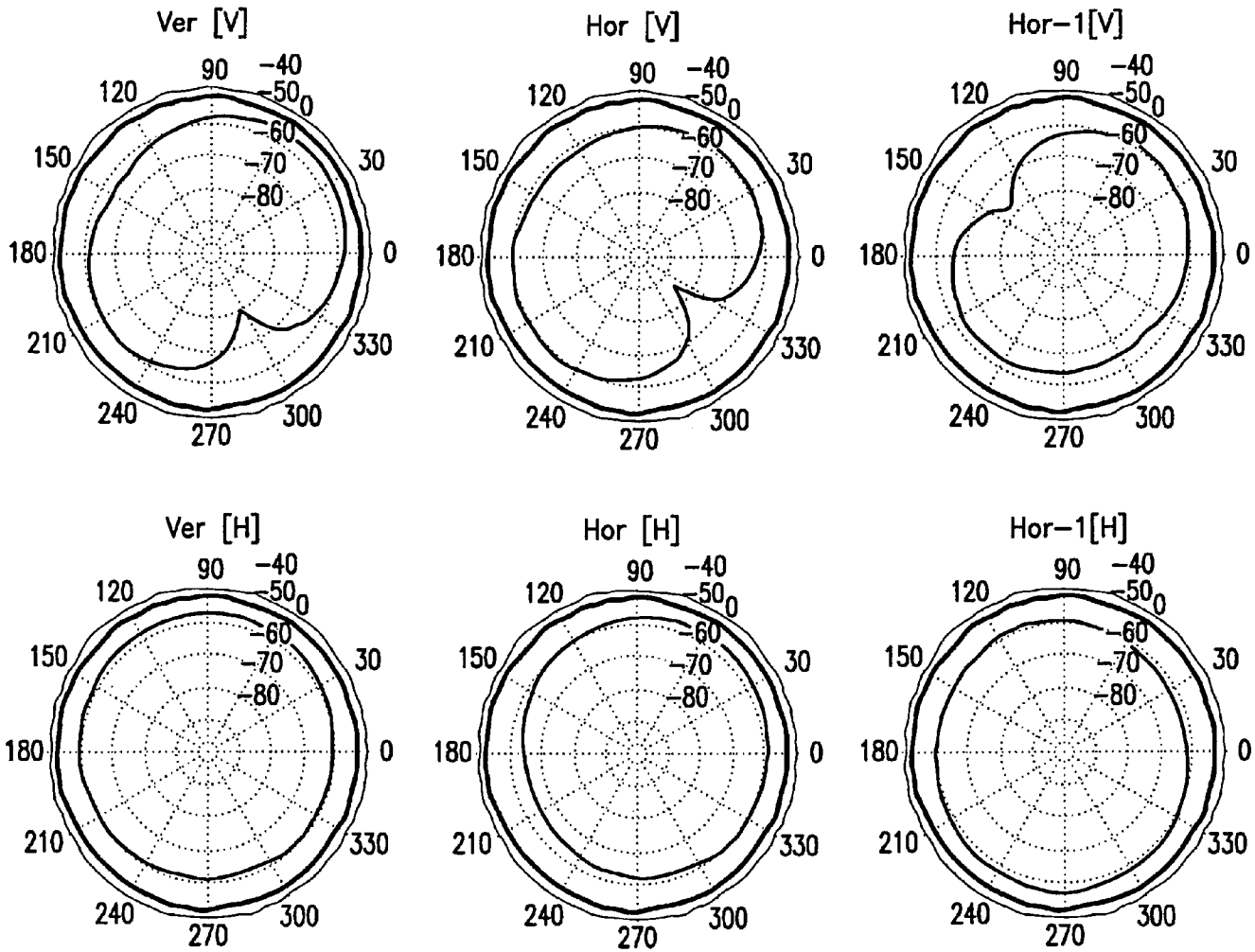

FIG. 4 is a chart of effective radiated power ERP from the FM radio utilizing the antenna of FIG. 1B (with two windings), with various plots of measured radiation pattern and the standard ETSI vertical and horizontal pattern specification limits (exterior circle) at the right side of the figure.

Figure 5A:
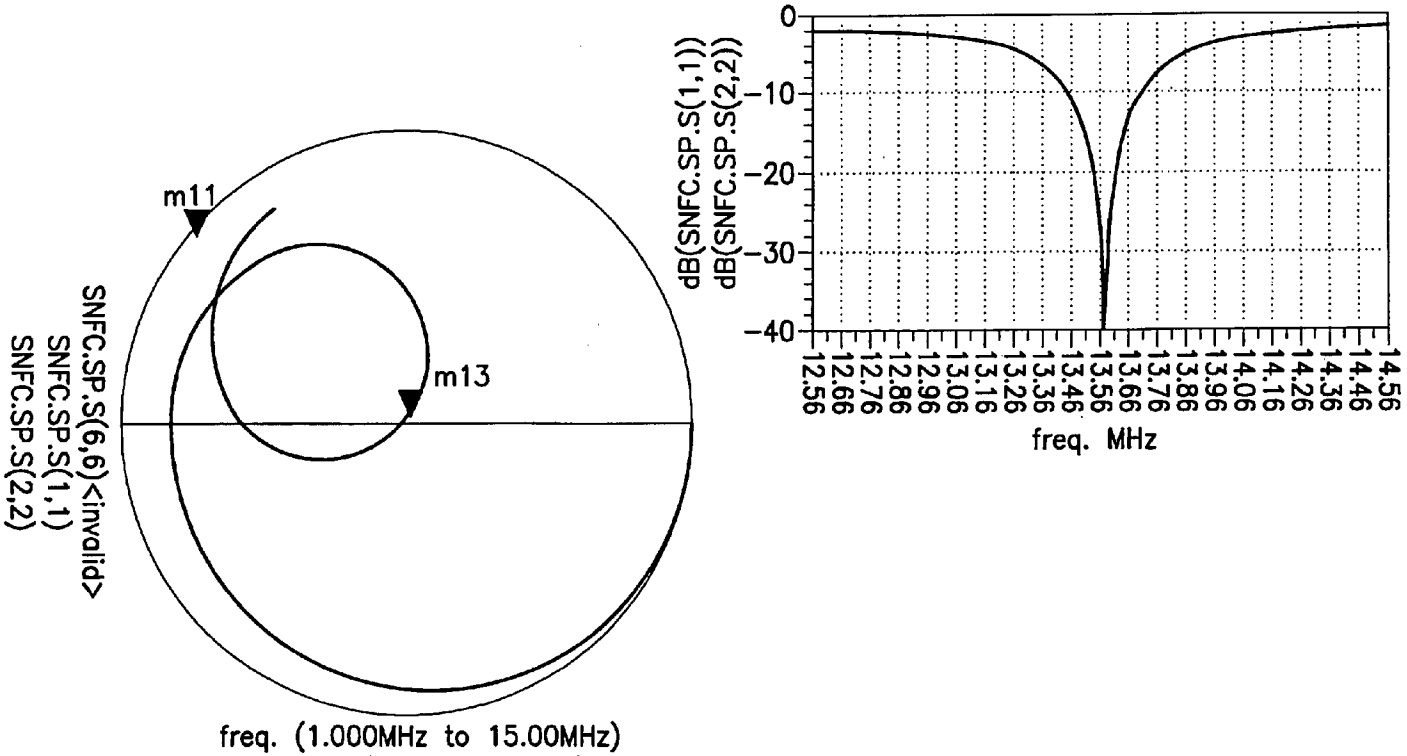
FIGS. 5-8 are Smith charts and voltage-power plots for RFID/NFC output power at various stages of building the circuit of FIG. 10A.
Figures 5, 5B:
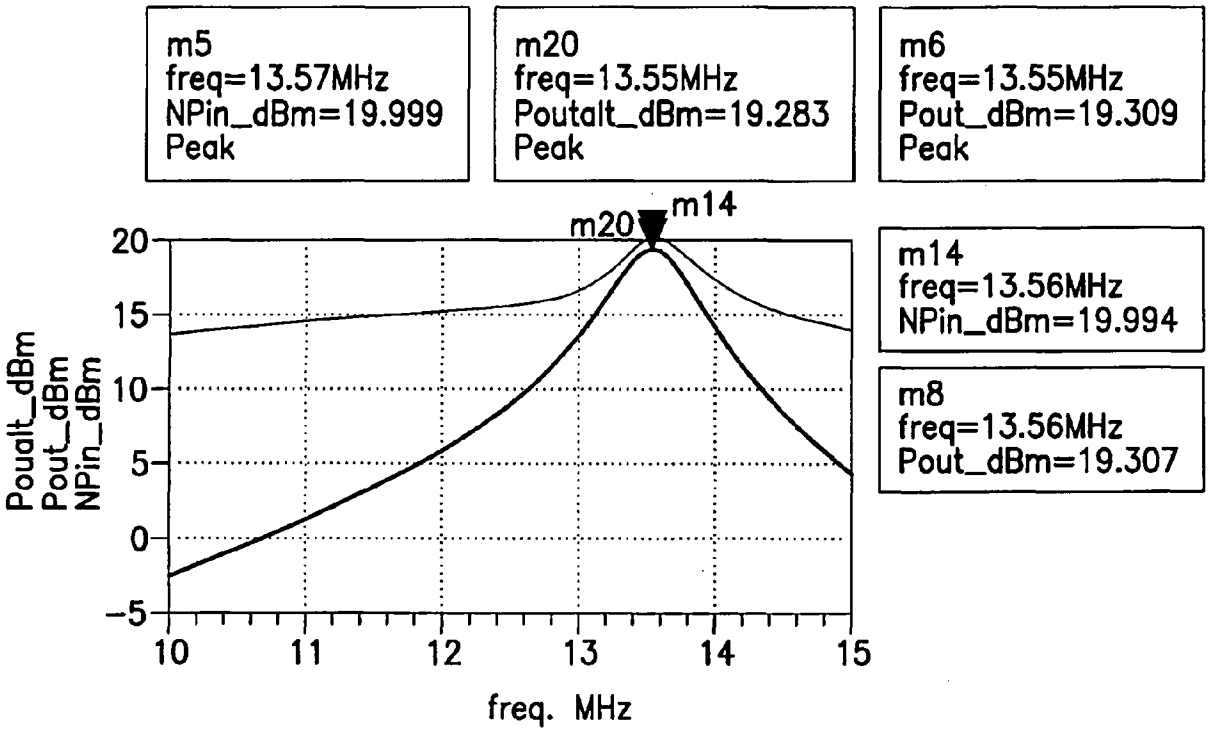

FIG. 5 is a Smith chart and power-frequency plot for the reference case in which there is no FM radio at all in the circuit. The specific circuit for which FIGS. 5-9 and 10B refer is shown generally at FIG. 10A with exceptions noted for the various figures. Since FIG. 5 is a reference for RFID/NFC output power there is only a loop antenna with no FM antenna attached to it.

Figure 6A:
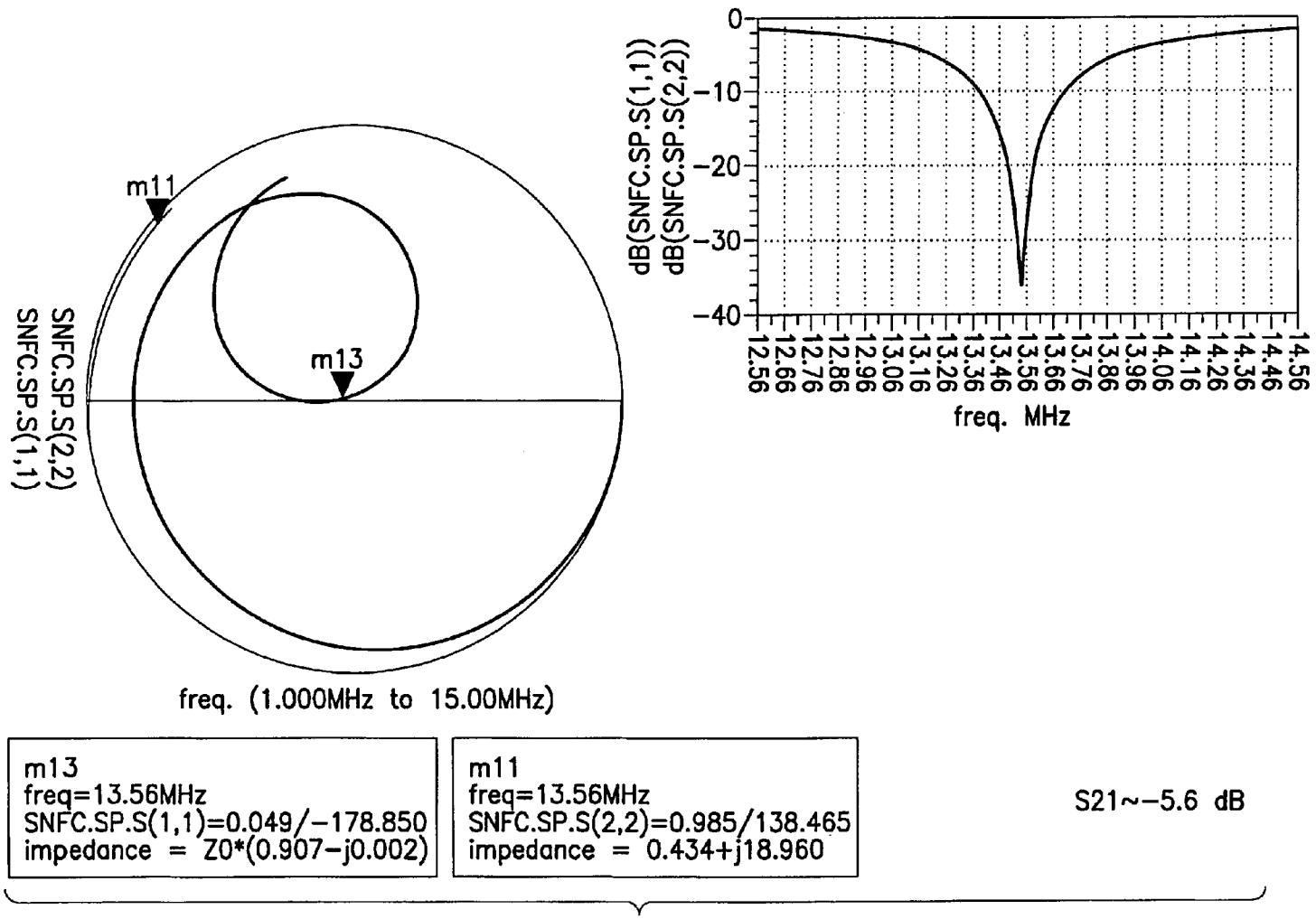
Figure 7A:
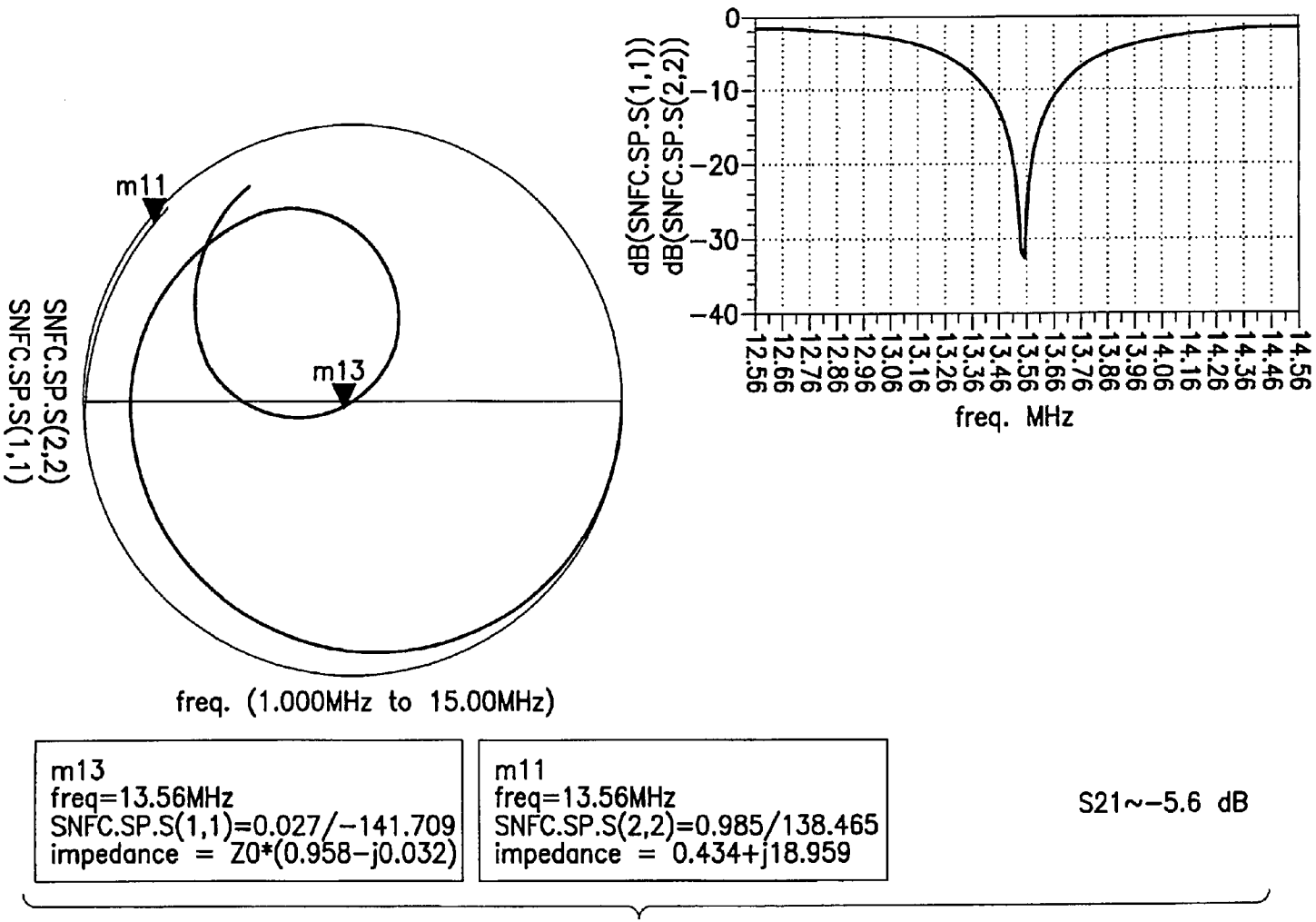

FIG. 6 is similar to FIG. 5 but while the FM radio is present it is shorted to ground for the FIG. 6 data with a loss of RFID/NFC output power as a consequence. FIG. 7 is similar to FIG. 6 but the circuit for which the data represents has the third feedpoint connected to a 50 ohm resistance.

FIG. 8 is similar to FIG. 7 but showing RFID/NFC radio output power for the circuit to which is added the compensating circuitry 116. Thus FIGS. 5-8 each show output power of the RFID/NFC radio in various stages of adding further components to a conventional loop antenna so as to arrive at the circuit of FIG. 1B (with two windings).

Figure 8A:
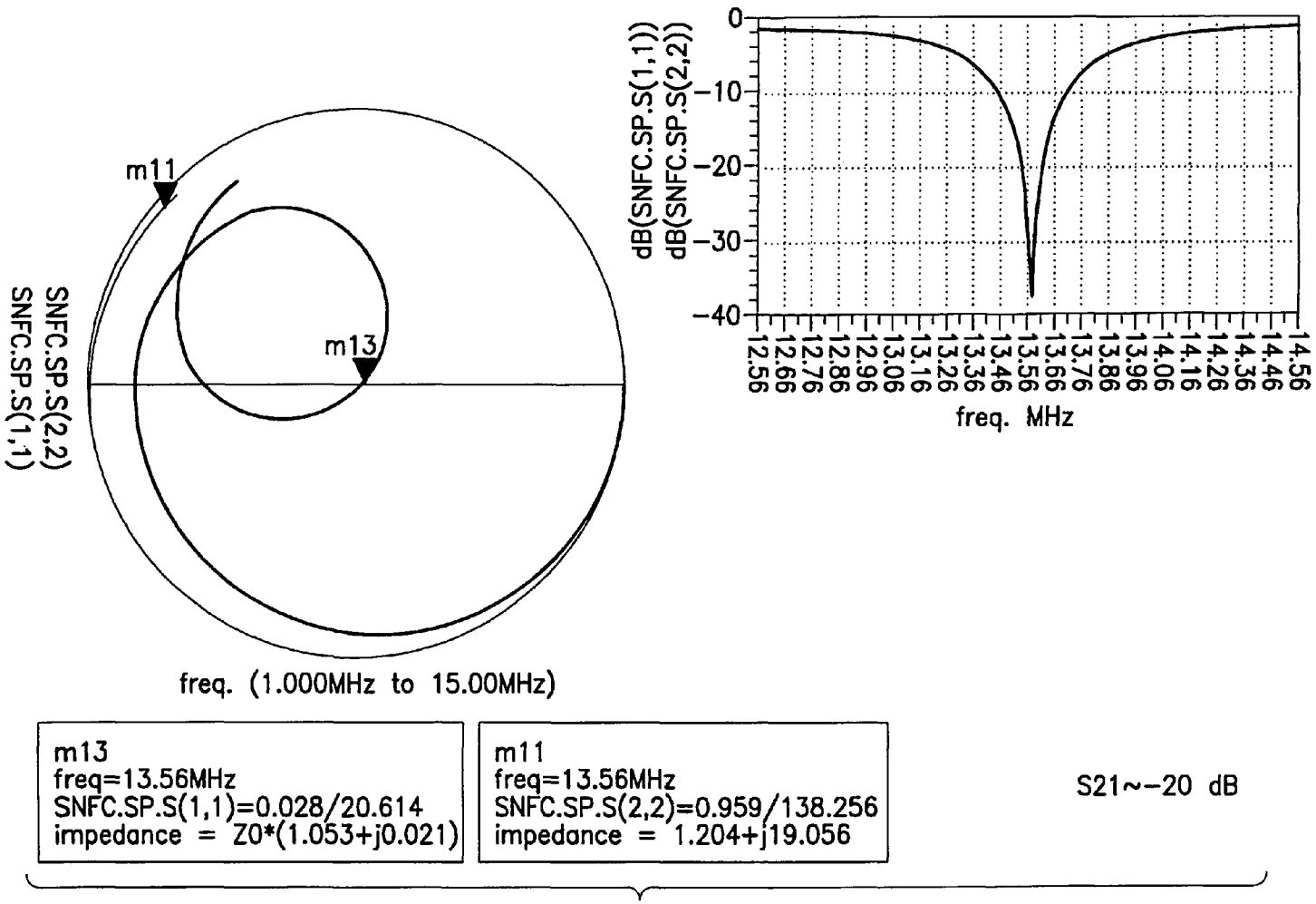
Figure 9A:
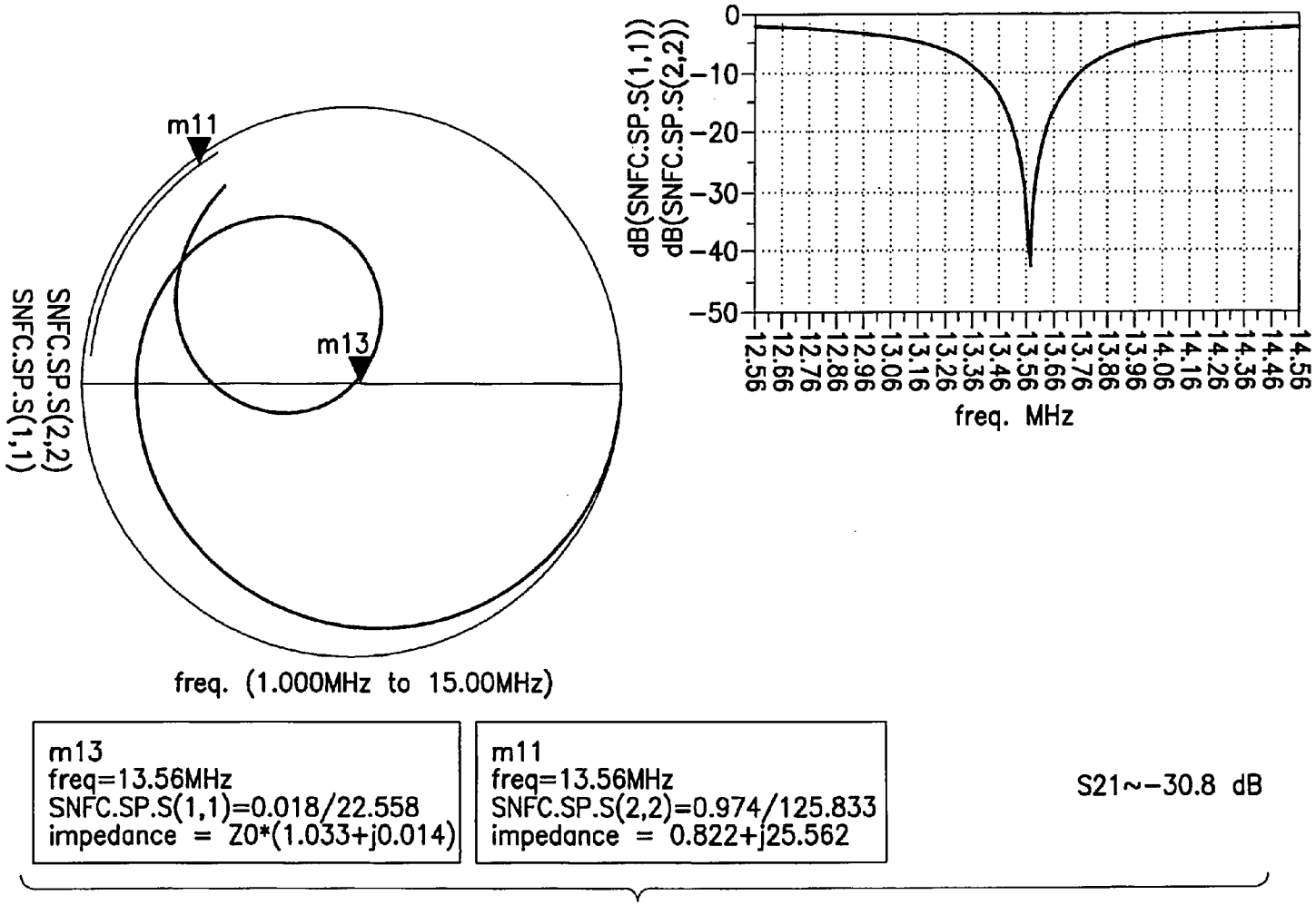
FIG. 9 is similar to FIG. 8 but for a different arrangement of compensating circuitry for the circuit of FIG. 10A.
Figure 10A:
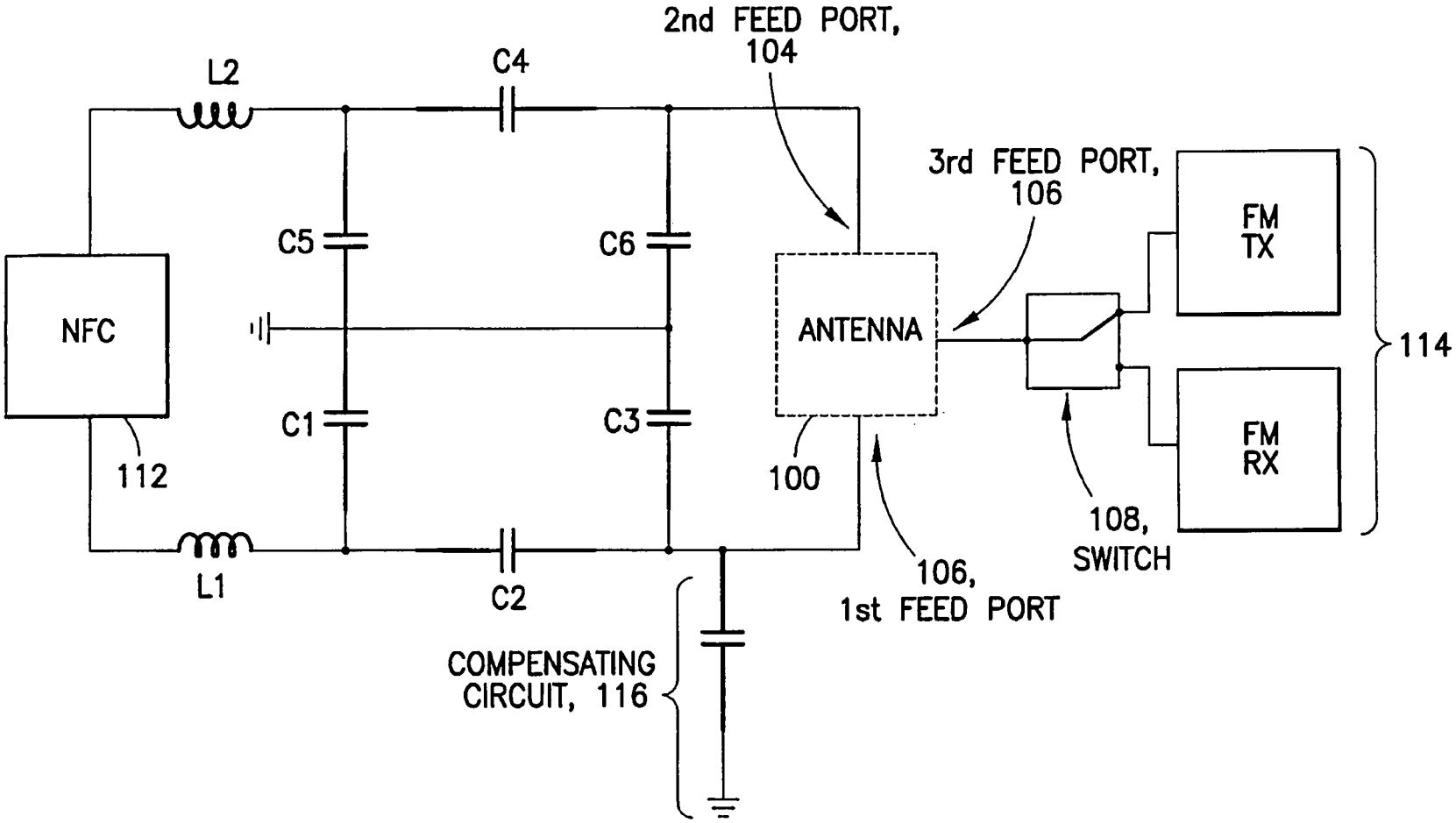
FIG. 10A is a more detailed circuit diagram than FIG. 1B and including a matching circuit for the RFID/NFC radio.

FIG. 9 is similar to FIG. 8 but with a different arrangement of the compensation circuitry 116, specifically an inductor and capacitor disposed along the radiating element 100 itself and arranged in series between the third feed port 106 and the first feed port 102, rather than a capacitor to ground coupled to the radiating element 100 as in FIGS. 1B and 10A.

Note that at FIG. 10A there is a switch 108 for switching the coupling of the third feed port 106 between FM-TX and FM-RX, if both the FM radio systems are to be implemented; effectively sharing the radiator between these two systems. FIG. 10A shows the antenna 100 itself only as a block representation without form, in order to more clearly show its position relative to various matching circuits and radios.

Similar to sub-circuit SC2 at FIG. 1 of the above-referenced and co-owned U.S. patent application Ser. No. 12/387,355 (published as U.S. 2010/0277383), FIG. 10A also shows a matching circuit between the RFID/NFC radio 112 which blocks the FM-RX and/or FM-TX signals. Specifically, there are capacitors C1 and C5 coupling to ground on a first crossover line and capacitors C3 and C6 coupling to ground on a second crossover line in parallel with the first crossover line. The matching circuit also includes inductances L1 and L2, and capacitances C2 and C4 as shown. Inductances L1 and L2 are configured to block signals in the FM-RX and FM-TX bands from coupling to the RFID/NFC radio 112. The matching circuit shown at FIG. 10A is illustrative only and not limiting.

There may also be a matching circuit (not shown) for the FM radio 114. FIG. 10A illustrates separate FM-TX and FM-RX radios where both radios interface to the antenna 100 via the third feed port 106, in which the switch 108 selects between the FM-TX radio and the FM-RX radio. In another exemplary embodiment the FM radio 114 is implemented as one of the FM-TX or FM-RX radios but not both, and thus no need for such a switch 108.

Figure 10B:
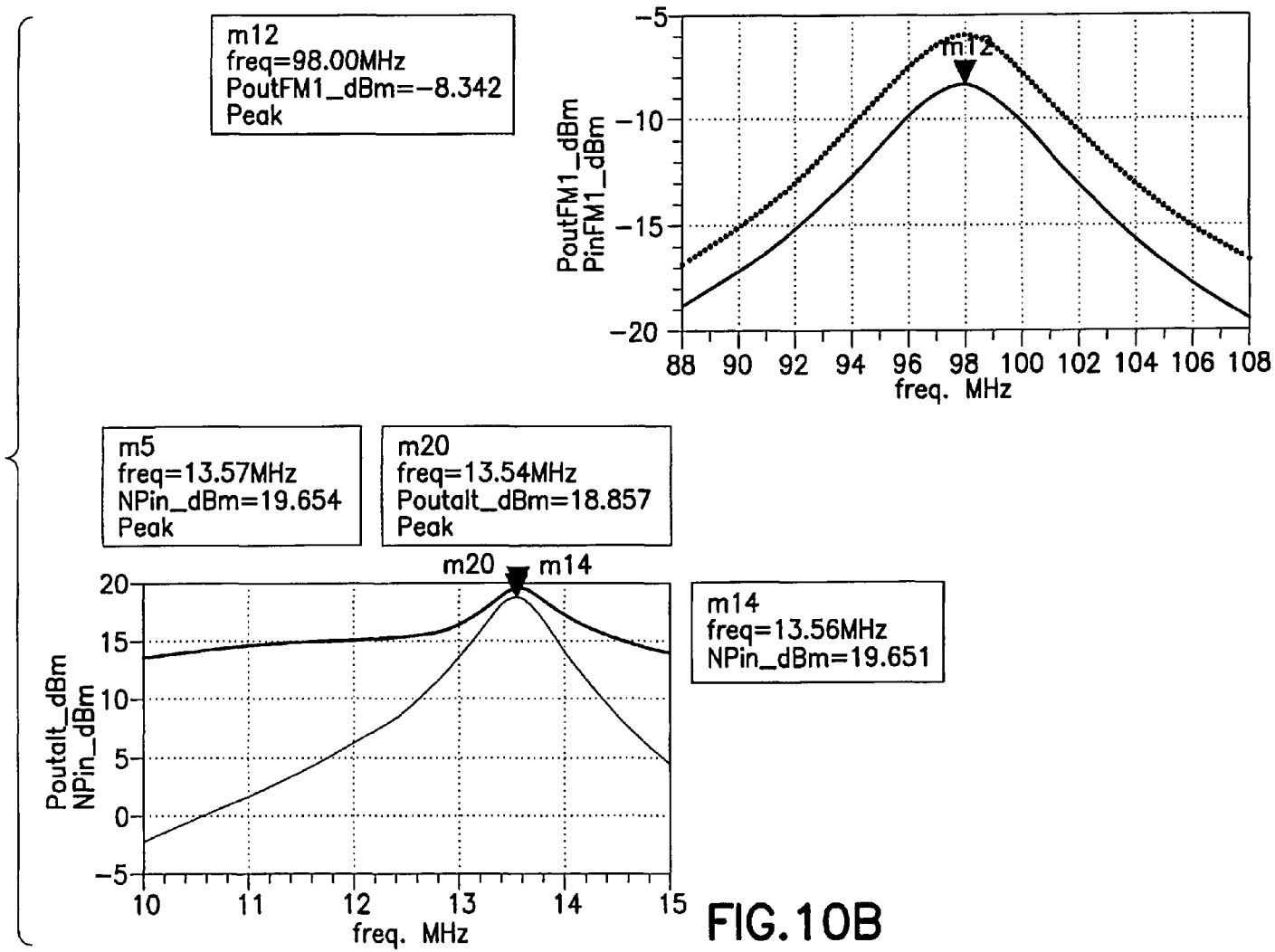
FIG. 10B is similar to FIG. 8 but also showing the FM-TX output power.

Finally at FIG. 10B is data for the circuit of FIG. 10A when the FM transmit radio is active as well as the RFID/NFC. The figure shows almost identical output power for the RFID/NFC as the reference circuit, but now also allows FM-TX transmission.

Embodiments of this invention may be incorporated into the multi-protocol antenna described in the co-owned U.S. patent applications referenced in the background section above. Certain aspects of the layout of FIG. 8A is similar to that multiprotocol antenna, for example the matching circuit adjacent to the first and second feed ports 102, 104 is described as sub-circuit SC2 at co-owned U.S. patent application Ser. No. 12/387,355 (filed on Apr. 30, 2009; published as U.S. 2010/0277383). Thus embodiments of the invention as incorporated into such a multi-protocol antenna may utilize a single radiating element 100 for more than the two radios 112, 114 in the specific embodiments above. Other techniques to interface a third, fourth, etc. radio to the same radiating element 100 may also be utilized.

Figure 11A:
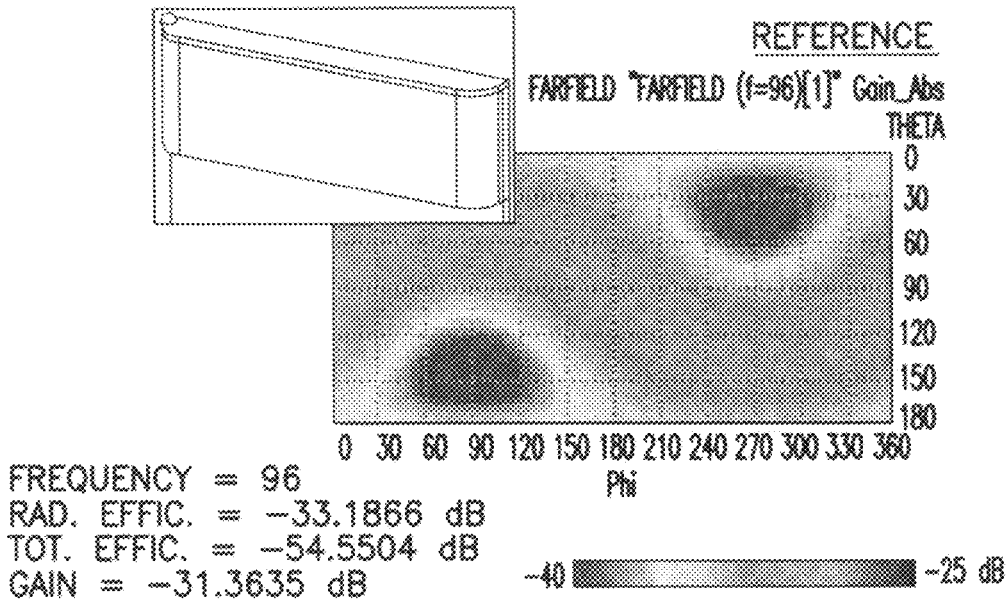
FIGS. 11A-C are radiation patterns for a loop antenna with the location of the FM feed port at different positions along the coil radiating element relative to the RFID/NFC feed ports.
Figure 11B:
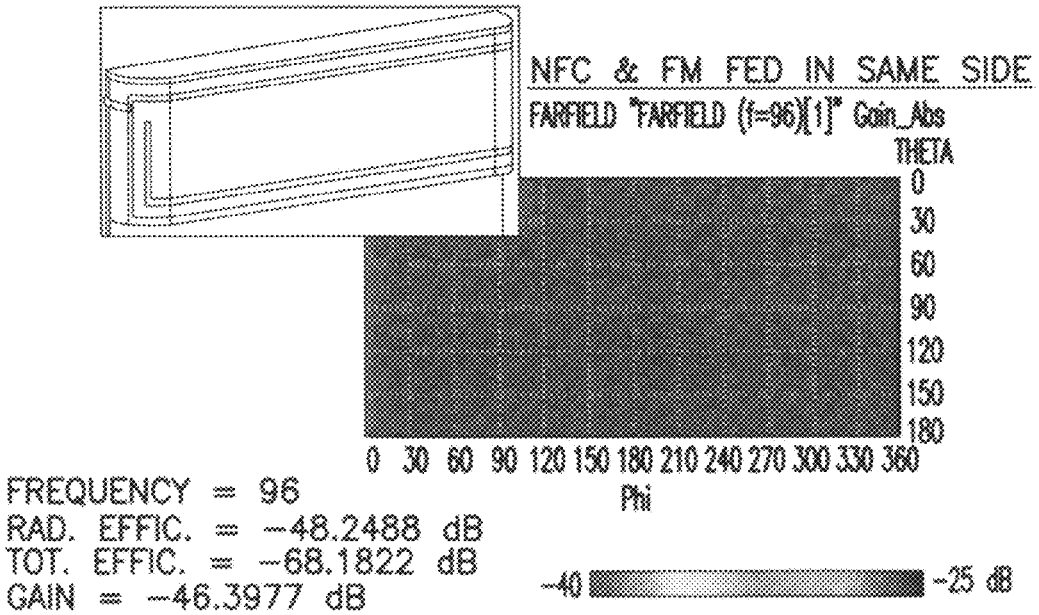
Figure 11C:
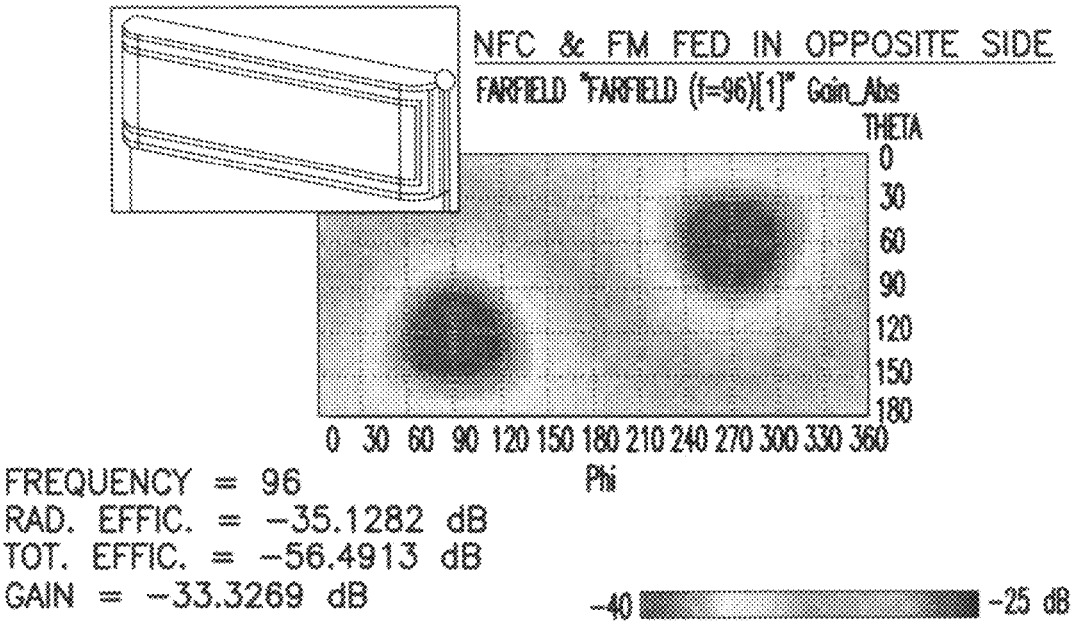

FIGS. 11A-C compare radiation patterns for different positioning of the third/FM feed port 106 along the radiating element 100. These examples use simple traces for the radiating element 100 with no compensating circuitry so the position comparisons for the third feed port 106 are not biased. For reference data at FIG. 11A there is no RFID/NFC radio connected and only the FM radio interfaced to that radiating element 100, showing good efficiency and gain. FIG. 11B shows the radiating element with the RFID/NFC radio 112 and the FM radio 114 fed from the same side of the coil 100, with very low gain and poor efficiency, meaning a high risk of poor user experience. FIG. 11C represents the first embodiment detailed above with the RFID/NFC radio 112 and the FM radio 114 interfacing at feeds lying on opposed sides of the coiled radiating element 100. It can be seen the phase profile at FIG. 11C is only marginally less favorable than that of FIG. 11A, so the opposite feed has little performance cost for the handset layout designer to add both FM and RFID/NFC radio as opposed to adding only a RFID/NFC radio.

Figure 12:
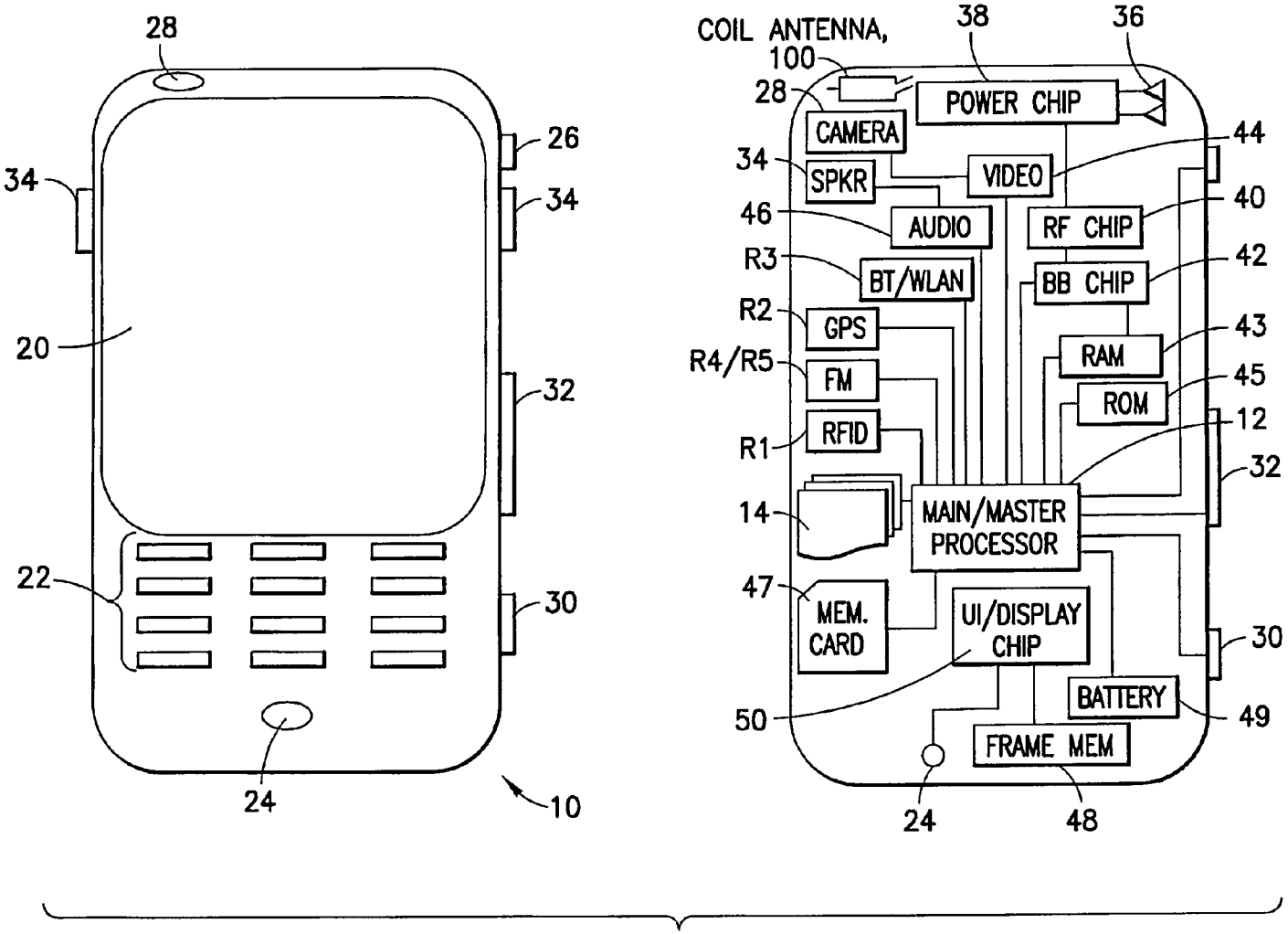
FIG. 12 is a schematic diagram in plan view (left) and sectional view (right) of a mobile handset according to an example embodiment of the invention.

Above it was described that a mobile handset is a particularly challenging environment for designing multi-radios and their related antennas. Such an exemplary mobile handset, alternatively termed a user equipment (UE), is shown at FIG. 12 in both plan view (left) and sectional view (right). The UE 10 has a graphical display interface 20 and a user interface 22 illustrated as a keypad but understood as also encompassing touch-screen technology at the graphical display interface 20 and voice-recognition technology received at the microphone 24. A power actuator 26 controls the device being turned on and off by the user. The example UE 10 may have a camera 28 (forward and/or rear facing) which is controlled by a shutter actuator 30 and optionally also a zoom actuator 32 which may alternatively function as a volume adjustment for the speaker(s) 34 when the camera 28 is not in an active mode.

Within the sectional view of FIG. 12 are seen multiple transmit/receive antennas 36 that are typically used for cellular communication and in the example embodiments detailed above are separate and distinct from the above-described radiating element 100. These cellular antennas 36 may themselves be single or multi-band for use with cellular radios in the UE. There is a power chip 38 which controls output power to the antennas for transmission, and which amplifies received signals. Those functions may instead be performed within the RF chip 40 (such as by amplifiers and related circuitry), in which case the antennas 36 interface to the RF chip 40 directly.

The operable ground plane for the antennas 36 is shown by shading as spanning the entire space enclosed by the UE housing though in some embodiments the ground plane may be limited to a smaller area, such as disposed on a printed wiring board on which the power chip 38 is formed. The ground plane for the radiating element 100 according to these teachings may be common with the ground plane used for the cellular antennas, or it may be separate and distinct physically even if coupled to the same ground potential. By example the ground plane may be disposed on one or more layers of one or more printed wiring boards within the UE 10, and/or alternatively or additionally the ground plane may be formed from a solid conductive material such as a shield or protective case or it may be formed from printed, etched, moulded, or any other method of providing a conductive sheet in two or three dimensions. The power chip 38 outputs the amplified received signal to the radio-frequency (RF) chip 40 which demodulates and downconverts the various signals for baseband processing. The baseband (BB) chip 42 detects the signal which is then converted to a bit-stream and finally decoded. Similar processing occurs in reverse for signals generated in the apparatus 10 and transmitted from it.

The secondary radios (Bluetooth/WLAN shown together as R3, RFID shown as R1, GPS shown as R2, and FM shown as R4/R5) may use some or all of the processing functionality of the RF chip 40, and/or the baseband chip 42. The antenna radiating element 100 may wrap partially or in whole about a periphery of the housing so as to obtain a maximum size loop length (e.g., 8-15 cm); the illustration at FIG. 12 of the radiating element 100 is not limiting in position or size. Due to the crowded diagram, ports, circuitry, and filters are not illustrated at FIG. 12 but the teachings arising from the example embodiments at FIGS. 1A-B and 10A give examples as to those components, wherever they may be physically disposed within the overall UE 10.

There may be for the camera 28 function an image/video processor 44 which encodes and decodes the various image frames. A separate audio processor 46 may also be present controlling signals to and from the speakers 34 and the microphone 24. The graphical display interface 20 is refreshed from a frame memory 48 as controlled by a user interface chip 50 which may process signals to and from the display interface 20 and/or additionally process user inputs from the keypad 22 and elsewhere.

Throughout the apparatus are various memories such as random access memory RAM 43, read only memory ROM 45, and in some embodiments removable memory such as the illustrated memory card 47 on which various programs of computer readable instructions are stored for controlling operation of the UE. All of these components within the UE 10 are normally powered by a portable power supply such as a battery 49.

The aforesaid processors 38, 40, 42, 44, 46, 50, if embodied as separate entities in a UE 10, may operate in a slave relationship to the main processor 12, which may then be in a master relationship to them. Any or all of these various processors of FIG. 12 access one or more of the various memories, which may be on-chip with the processor or separate therefrom.

Note that the various chips (e.g., 38, 40, 42, etc.) that were described above may be combined into a fewer number than described and, in a most compact case, may all be embodied physically within a single chip.

Figure 13:
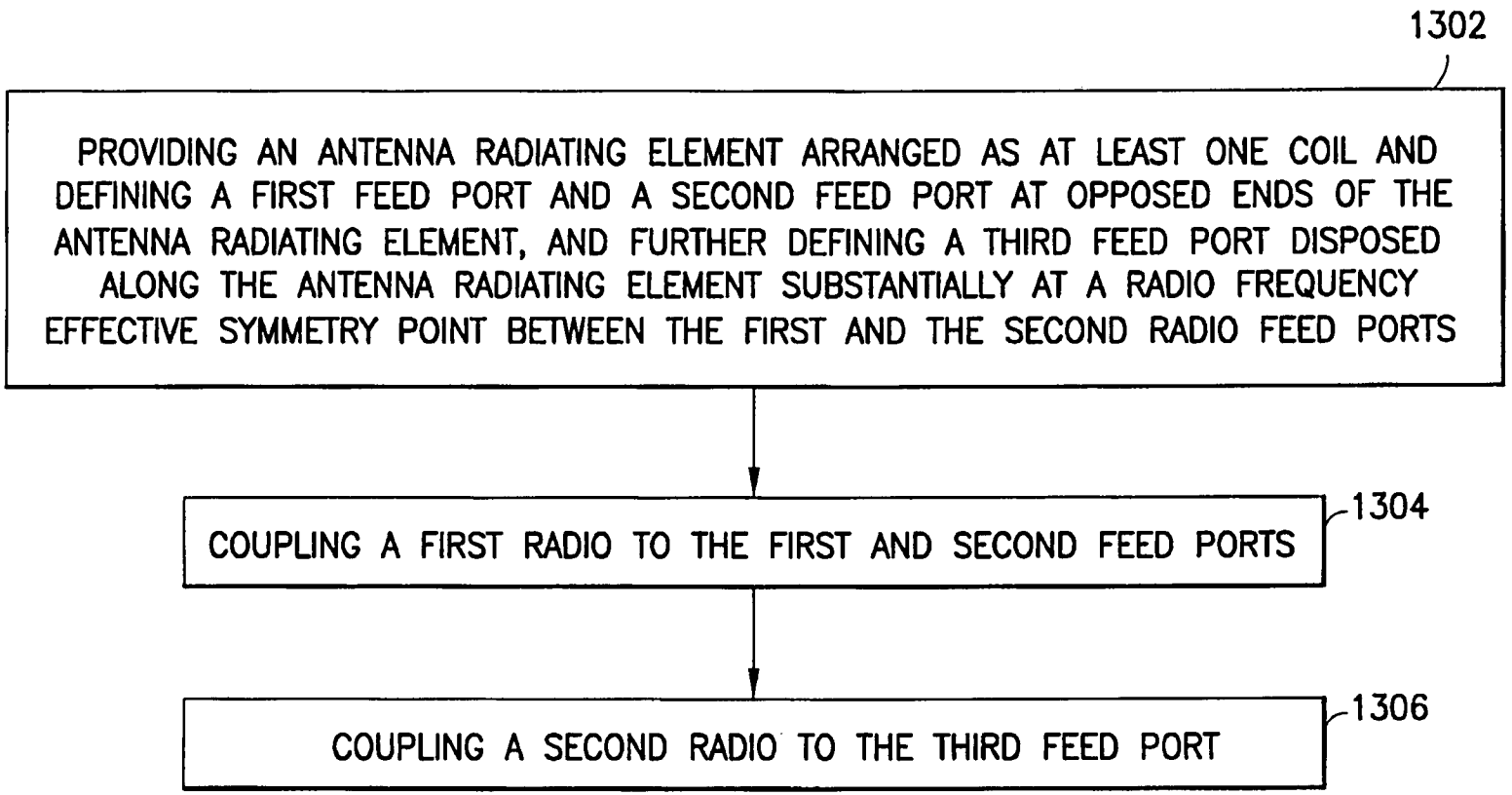
FIG. 13 is a logic flow diagram that illustrates the operation of a method, and a result of execution of computer program instructions embodied on a computer readable memory, in accordance with an example embodiment of the invention.

FIG. 13 is a logic flow diagram that illustrates the operation of a method for making an electronic apparatus in accordance with the example embodiments of this invention. Such an example and non-limiting method may comprise at block 1302 providing an antenna radiating element arranged as at least one coil and defining a first feed port and a second feed port at opposed ends of the antenna radiating element, and further defining a third feed port disposed along the antenna radiating element substantially at a radio frequency effective symmetry point between the first and the second radio feed ports. Block 1304 shows the additional coupling of a first radio to the first and second feed ports, and block 1306 shows coupling a second radio to the third feed port. Further and additional blocks may be evident for certain exemplary embodiments from the above detailed teachings.

The various blocks shown in FIG. 13 may be viewed as method steps, and/or as operations that result from operation of computer program code, and/or as a plurality of coupled logic circuit elements constructed to carry out the associated function(s). It should be appreciated that although the blocks shown in FIG. 13 are in a specific order, these blocks may be carried out in any order or even some of the blocks may be omitted as required.

In general, the various example embodiments and controls therefore may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the example embodiments of this invention may be illustrated and described as block diagrams, flow charts, or using some other pictorial representation, it is well understood that these blocks, apparatus, systems, techniques or methods described herein may be implemented in, as nonlimiting examples, hardware, software, firmware, special purpose circuits or logic, general purpose hardware or controller or other computing devices, or some combination thereof.

It should thus be appreciated that at least some aspects of the example embodiments of the inventions may be practiced in various components such as integrated circuit chips and modules, and that the example embodiments of this invention may be realized in an apparatus that is embodied as an integrated circuit. The integrated circuit, or circuits, may comprise circuitry (as well as possibly firmware) for embodying at least one or more of a data processor or data processors, a digital signal processor or processors, baseband circuitry and radio frequency circuitry that are configurable so as to operate in accordance with the example embodiments of this invention.

Various modifications and adaptations to the foregoing example embodiments of this invention may become apparent to those skilled in the relevant arts in view of the foregoing description, when read in conjunction with the accompanying drawings. However, any and all modifications will still fall within the scope of the non-limiting and example embodiments of this invention.

It should be noted that the terms "connected," "coupled," or any variant thereof, mean any connection or coupling, either direct or indirect, between two or more elements, and may encompass the presence of one or more intermediate elements between two elements that are "connected" or "coupled" together. The coupling or connection between the elements can be physical, logical, or a combination thereof. As employed herein two elements may be considered to be "connected" or "coupled" together by the use of one or more wires, cables and/or printed electrical connections, as well as by the use of electromagnetic energy, such as electromagnetic energy having wavelengths in the radio frequency region, the microwave region and the optical (both visible and invisible) region, as several non-limiting and non-exhaustive examples.

Furthermore, some of the features of the various non-limiting and example embodiments of this invention may be used to advantage without the corresponding use of other features. As such, the foregoing description should be considered as merely illustrative of the principles, teachings and example embodiments of this invention, and not in limitation thereof.

We claim:

1. An apparatus comprising:

an antenna radiating element arranged as at least one coil and defining a first feed port and a second feed port at opposed ends of the antenna radiating element, in which the first and second feed ports are configured to interface a first radio to the antenna radiating element;

a third feed port disposed along the antenna radiating element substantially at one of a physical symmetry point and a radio frequency effective symmetry point between the first and the second feed ports, in which the third feed port is configured to interface a second radio to the antenna radiating element;

wherein the apparatus is free of filtering components for isolating different bands from one another, and wherein a relative location of the third feed port and the first and second feed ports provides band isolation.

2. The apparatus according to claim 1, further comprising the first radio coupled to the first and second feed ports and the second radio coupled to the third feed port, in which the first radio comprises a RFID radio and the second radio comprises a broadcast FM radio transmitter.

3. The apparatus according to claim 2, in which the RFID radio comprises a near field communications radio.

4. The apparatus according to claim 2, in which the antenna radiating element is configured to function simultaneously as a balanced coil antenna with respect to the first radio and as two parallel half-loop antennas with respect to the second radio.

5. The apparatus according to claim 1, in which the third feed port is disposed along the antenna radiating element within ten percent of halfway along a length of the antenna radiating element between the first and second feed ports.

6. The apparatus according to claim 1, in which the third feed port is disposed along the antenna radiating element nearer to the first feed port than to the second feed port;

in which the apparatus further comprises compensation circuitry disposed along the antenna radiating element between the third feed port and the first feed port which compensates a first radio frequency effective length along the antenna radiating element between the third feed port and the first feed port to be substantially equivalent to a second radio frequency effective length along the antenna radiating element between the third feed port and the second feed port.

7. The apparatus according to claim 6, in which the apparatus is disposed within a mobile handset device.

8. The apparatus according to claim 1 wherein the third feed port is disposed along the antenna radiating element substantially at the radio frequency effective symmetry point between the first and the second feed ports, wherein the radio frequency effective symmetry point is compensated to be the radio frequency effective symmetry point of an RFID/NFC coil by compensation circuitry.

9. The apparatus according to claim 1 wherein the at least one coil has a first resonance when fed by the first and second ports and a second resonance, different to the first resonance, when fed by the third port.

10. The apparatus according to claim 1 further comprising:

a first conductive portion disposed between the first feed port and the third feed port; and a second conductive portion disposed between the second feed port and the third feed port, wherein the first and second conductive portions are configured to operate as half-loop antennae for the second radio and configured to operate as a balanced loop antenna for the first radio.

11. A method comprising:

providing an antenna radiating element arranged as at least one coil and defining a first feed port and a second feed port at opposed ends of the antenna radiating element, and further defining a third feed port disposed along the antenna radiating element substantially at one of a physical symmetry point and a radio frequency effective symmetry point between the first and the second radio feed ports;

coupling a first radio to the first and second feed ports; and coupling a second radio to the third feed port;

wherein the antenna radiating element is free of filtering components for isolating different bands from one another, and wherein a relative location of the third feed port and the first and second feed ports provides band isolation.

12. The method according to claim 11, in which the first radio comprises a RFID radio and the second radio comprises a broadcast FM radio transmitter.

13. The method according to claim 12, in which the RFID radio comprises a near field communications radio.

14. The method according to claim 12, in which the antenna radiating element is configured to function simultaneously as a balanced coil antenna with respect to the first radio and as two parallel half-loop antennas with respect to the second radio.

15. The method according to claim 11, in which the third feed port is disposed along the antenna radiating element within ten percent of halfway along a length of the antenna radiating element between the first and second feed ports.

16. The method according to claim 11, in which the third feed port is disposed along the antenna radiating element nearer to the first feed port than to the second feed port;

in which the antenna radiating element further comprises compensation circuitry disposed between the third feed port and the first feed port which compensates a first radio frequency effective length along the antenna radiating element between the third feed port and the first feed port to be substantially equivalent to a second radio frequency effective length along the antenna radiating element between the third feed port and the second feed port.

17. The method according to claim 16, further comprising disposing the antenna radiating element, the compensation circuitry, the first radio and the second radio within a mobile handset device.

* * * * *

UNITED STATES PATENT AND TRADEMARK OFFICE

CERTIFICATE OF CORRECTION

PATENT NO. : 8,610,638 B2
APPLICATION NO. : 13/007710
DATED : December 17, 2013
INVENTOR(S) : Niels B. Larsen and Jouni V. Karkinen It is certified that error appears in the above-identified patent and that said Letters Patent is hereby corrected as shown below:

In the Claims:

In Claim 10:
Column 10, line 45, "antennae" should be deleted and --antennas-- should be inserted.

Signed and Sealed this
Twenty-fifth Day of March, 2014

Michelle K. Lee

Michelle K. Lee
*Deputy Director of the United States Patent and Trademark Office*